US010741920B2

(12) United States Patent
Veihl et al.

(10) Patent No.: US 10,741,920 B2
(45) Date of Patent: Aug. 11, 2020

(54) BROADBAND STACKED PATCH RADIATING ELEMENTS AND RELATED PHASED ARRAY ANTENNAS

(71) Applicant: CommScope Technologies LLC, Hickory, NC (US)

(72) Inventors: Jonathon C. Veihl, New Lenox, IL (US); Michael L. Brobston, Allen, TX (US); Richard W. Brown, Forest, VA (US); Charles D. L. Bernardo, Port Barrington, IL (US)

(73) Assignee: CommScope Technologies LLC, Hickory, NC (US)

( * ) Notice: Subject to any disclaimer, the term of this patent is extended or adjusted under 35 U.S.C. 154(b) by 107 days.

(21) Appl. No.: 16/163,601

(22) Filed: Oct. 18, 2018

(65) Prior Publication Data

US 2019/0115664 A1 Apr. 18, 2019

Related U.S. Application Data

(60) Provisional application No. 62/573,749, filed on Oct. 18, 2017.

(51) Int. Cl.

| | |
|---|---|
| ***H01Q 5/50*** | (2015.01) |
| ***H01Q 9/04*** | (2006.01) |
| ***H01Q 5/385*** | (2015.01) |
| ***H01Q 21/06*** | (2006.01) |
| ***H01Q 21/00*** | (2006.01) |

(52) U.S. Cl.

CPC ..... *H01Q 9/0414* (2013.01); *H01Q 5/385* (2015.01); *H01Q 5/50* (2015.01); *H01Q 9/0435* (2013.01); *H01Q 21/0087* (2013.01); *H01Q 21/065* (2013.01)

(58) Field of Classification Search

CPC ..... H01G 9/0414; H01G 5/385; H01G 5/50; H01G 9/0435; H01G 21/0087; H01G 21/065

See application file for complete search history.

(56) References Cited

U.S. PATENT DOCUMENTS

2007/0126638 A1 6/2007 Channabasappa
2012/0242547 A1 9/2012 Fujii et al.

OTHER PUBLICATIONS

Notification of Transmittal of the International Search Report and the Written Opinion of the International Searching Authority, or the Declaration, for corresponding International Application No. PCT/US2018/056275, dated Jan. 25, 2019, 11 pages.

*Primary Examiner* — Graham P Smith
(74) *Attorney, Agent, or Firm* — Myers Bigel, P.A.

(57) ABSTRACT

A stacked patch radiating element includes a dielectric substrate, a ground plane on a first surface of the dielectric substrate, a patch radiator on a second surface of the dielectric substrate, a feed that is configured to connect the patch radiator to a transmission line, a solder layer on the patch radiator opposite the dielectric substrate, and a parasitic radiating element on the solder layer opposite the patch radiator. The parasitic radiating element includes a metal layer on the solder, a parasitic radiator dielectric substrate on the first metal layer opposite the solder, and a parasitic radiator on the parasitic radiator dielectric substrate opposite the first metal layer.

20 Claims, 15 Drawing Sheets

BROADBAND STACKED PATCH RADIATING ELEMENTS AND RELATED PHASED ARRAY ANTENNAS

CROSS-REFERENCE TO RELATED APPLICATION

The present application claims priority under 35 U.S.C. § 119 to U.S. Provisional Patent Application Ser. No. 62/573,749, filed Oct. 18, 2017, the entire contents of which is incorporated herein by reference as if set forth in its entirety.

FIELD

The present invention relates to communications systems and, more particularly, to phased array antennas including patch radiating elements.

BACKGROUND

Wireless radio frequency ("RF") communications systems, such as cellular communications systems, WiFi networks, microwave backhaul systems and the like, are well known in the art. Some of these systems, such as cellular communication systems, operate in the "licensed" frequency spectrum where use of the frequency band is carefully regulated so that only specific users in any given geographical region can operate in selected portions of the frequency band to avoid interference. Other systems such as WiFi operate in the "unlicensed" frequency spectrum which is available to all users, albeit typically with limits on transmit power to reduce interference.

Cellular communications systems are now widely deployed. In a typical cellular communications system, a geographic area is divided into a series of regions that are referred to as "cells," and each cell is served by a base station. The base station may include baseband equipment, radios and antennas that are configured to provide two-way RF communications with fixed and mobile subscribers that are positioned throughout the cell. The base station antennas generate radiation beams ("antenna beams") that are directed outwardly to serve the entire cell or a portion thereof. Typically, a base station antenna includes one or more phase-controlled arrays of radiating elements, which are commonly referred to as phased array antennas.

There has been a rapid increase in the demand for wireless communications, with many new applications being proposed in which wireless communications will replace communications that were previously carried over copper or fiber optic communications cables. Conventionally, most wireless communications systems operate at frequencies below 6.0 GHz, with a few notable exceptions such as microwave backhaul systems, various military applications and the like. As capacity requirements continue to increase, the use of higher frequencies is being considered for many applications, including frequencies in both the licensed and unlicensed spectrum. As higher frequencies are considered, the millimeter wave spectrum, which includes frequencies from approximately 25 GHz to as high as about 300 GHz, is a potential candidate, as there are large contiguous frequency bands in this frequency range that are potentially available for new applications. The use of cellular technology has also been contemplated for so-called "fixed wireless access" applications such as connecting cable television or other optical fiber, coaxial cable or hybrid coaxial cable-fiber optic broadband networks to individual subscriber premises over wireless "drop" links. There currently is interest in potentially deploying communications systems that operate in the 28 GHz to 60 GHz (or even higher) frequency range for such fixed wireless access applications using fifth generation ("5G") cellular communications technology.

For many fifth generation (5G) cellular communications systems, full two dimensional beam-steering is being considered. These 5G cellular communications systems are time division multiplexed systems where different users or sets of users may be served during different time slots. For example, each 10 millisecond period (or some other small period of time) may represent a "frame" that is further divided into dozens or hundreds of individual time slots. Each user may be assigned one of the time slots and the base station may be configured to communicate with different users during their individual time slots of each frame. With full two dimensional beam-steering, the base station antenna may generate small, highly-focused antenna beams on a time slot-by-time slot basis as opposed to a constant antenna beam that covers a full sector. These highly-focused antenna beams are often referred to as "pencil beams," and the base station antenna adapts or "steers" the pencil beam so that it points at different users during each respective time slot. Pencil beams may have very high gains and reduced interference with neighboring cells, so they may provide significantly enhanced performance.

In order to generate pencil beams that are narrowed in both the azimuth and elevation planes, it is typically necessary to provide antennas having a two-dimensional array that includes multiple rows and columns of radiating elements with full phase distribution control. The antennas may be active antennas that have a separate transceiver (radio) for each radiating element in the planar array (or for individual sub-groups of radiating elements in some cases) to provide the full phase distribution control (i.e., the transceivers may act in coordinated fashion to transmit the same RF signal during any given time slot, with the amplitude and/or phase of the sub-components of the RF signal output by the different transceivers manipulated to generate the directional pencil beam radiation pattern). While this technique can provide very high throughput, the provision of planar array antennas and large numbers of individual transceivers may add a significant level of cost and complexity.

SUMMARY

Pursuant to embodiments of the present invention, stacked patch radiating elements are provided that include a dielectric substrate having first and second opposed surfaces, a ground plane on the first surface of the dielectric substrate, a patch radiator on the second surface of the dielectric substrate, a feed that is configured to connect the patch radiator to a transmission line, a solder layer on the patch radiator opposite the dielectric substrate, and a parasitic radiating element on the solder layer opposite the patch radiator. The parasitic radiating element includes a metal layer on the solder, a parasitic radiator dielectric substrate on the first metal layer opposite the solder, and a parasitic radiator on the parasitic radiator dielectric substrate opposite the first metal layer.

In some embodiments, a footprint of the parasitic radiator may be smaller than a footprint of the patch radiator.

In some embodiments, a center of the parasitic radiator may be substantially aligned with a center of the patch radiator.

In some embodiments, the solder layer directly may contact both the patch radiator and the metal layer.

In some embodiments, the patch radiator may be an inset patch radiator that includes an inset on one side, and the transmission line may connect to an interior portion of the patch radiator exposed through the inset. In such embodiments, the metal layer may include an inset on one side and the inset in the metal layer may be substantially aligned with the inset in the patch radiator. The parasitic radiator may not include an inset in any side thereof.

In some embodiments, a footprint of the metal layer may have substantially the same shape as a footprint of the patch radiator. In such embodiments, a footprint of the parasitic radiator may be different than a footprint of the metal layer.

In some embodiments, a first opening may extend through the dielectric substrate and a second opening may extend through the ground plane layer and connects to the first opening, the first and second openings being underneath the patch radiator.

In some embodiments, the stacked patch radiating may further include a dielectric cover on the parasitic radiator opposite the parasitic radiator dielectric substrate. The dielectric cover may be attached to the parasitic radiator via an adhesive layer.

In some embodiments, a first coefficient of thermal expansion of the parasitic radiator dielectric substrate may differ from a second coefficient of thermal expansion of the dielectric substrate by at least 100%.

In some embodiments, the dielectric substrate may include at least one vent hole underneath the patch radiator, and the ground plane may include an opening that is in fluid communication with the vent hole.

Pursuant to further embodiments of the present invention, methods of fabricating an array of stacked patch radiating elements are provided in which a substrate that includes a plurality of patch radiators on an upper surface thereof is provided. A solder mask is formed on the upper surface of the substrate, the solder mask including openings that expose the respective patch radiators. Solder-containing material is deposited on each of the patch radiators. Pick-and-place equipment is used to mount a plurality of parasitic radiating elements on respective ones of the patch radiators. Each parasitic radiating element comprises a parasitic radiator dielectric substrate that has a conductive solder contact layer on a first surface thereof and a parasitic metal layer on a second surface thereof that is opposite the first surface.

In some embodiments, the solder-containing material may comprise solder paste, and the method may further comprise heating the solder paste to form a molten solder layer on each of the patch radiators which upon cooling permanently bonds with the patch radiators.

In some embodiments, the conductive solder contact layer of each parasitic radiating element may directly contact the molten solder on which the respective parasitic radiating element is mounted.

In some embodiments, the substrate may further include a ground plane on a lower surface thereof, and underneath each of the patch radiators a first opening extends through the substrate and a second opening extends through the ground plane and connects to the first opening. At least some non-solder components of the solder containing material may be vented through the first and second openings.

In some embodiments, the method may further comprise forming a first metal pattern on a first side of a parasitic radiator dielectric substrate and forming a second metal pattern on a second side of the parasitic radiator dielectric substrate to form a parasitic radiator board, and then cutting the parasitic radiator board to form at least some of the plurality of parasitic radiating elements.

In some embodiments, the method may further include depositing each of the parasitic radiating elements onto an adhesive tape.

In some embodiments, a footprint of each parasitic radiator may be smaller than a footprint of the patch radiator on which the respective parasitic radiator is mounted.

In some embodiments, a center of each parasitic radiator may be substantially aligned with a center of the patch radiator on which the respective parasitic radiator is mounted.

In some embodiments, each patch radiator may be an inset patch radiator that includes an inset on one side, and each conductive solder contact layer may include an inset on one side that is substantially aligned with the inset in the respective patch radiator on which the solder contact metal layer is mounted.

In some embodiments, the parasitic radiator of each parasitic radiating element may not include any inset.

In some embodiments, each conductive solder contact layer may have substantially the same footprint, each patch radiator may have substantially the same footprint, and the footprint of each conductive solder contact layer may be substantially the same shape as a footprint of each patch radiator.

In some embodiments, for each parasitic radiating element, a footprint of the parasitic radiator may be different than a footprint of the conductive solder contact layer.

In some embodiments, the method may further include adhering a dielectric cover on the parasitic radiators opposite the patch radiators.

Pursuant to still further embodiments of the present invention, active antenna arrays are provided that include a base board that includes a dielectric substrate having first and second opposed surfaces, a ground plane on the first surface of the dielectric substrate, a plurality of patch radiators on the second surface of the dielectric substrate, and a plurality of feeds, each feed configured to connect a respective one of the patch radiators to one of a plurality of transmission lines of a feed network. The active antenna arrays may further include a solder mask having a plurality of openings on the second surface of the dielectric substrate, solder within the openings in the solder mask, and a plurality of parasitic radiating elements on the solder. Each parasitic radiating element includes a parasitic radiator dielectric substrate having a first surface and a second surface opposite the first surface, a conductive solder contact layer on the first surface of the parasitic radiator dielectric substrate, and a parasitic radiator on the second surface of the parasitic radiator dielectric substrate.

In some embodiments, a footprint of each parasitic radiator may be smaller than a footprint of the patch radiator on which the respective parasitic radiator is mounted.

In some embodiments, a center of each parasitic radiator may be substantially aligned with a center of the patch radiator on which the respective parasitic radiator is mounted.

In some embodiments, each patch radiator may be an inset patch radiator that includes an inset on one side, and each conductive solder contact layer includes an inset on one side that is substantially aligned with the inset in the respective patch radiator on which the conductive solder contact layer is mounted.

In some embodiments, the parasitic radiator of each parasitic radiating element may not include any inset.

In some embodiments, for each parasitic radiating element, a footprint of the parasitic radiator may be different than a footprint of the conductive solder contact layer.

In some embodiments, for each parasitic radiator, a footprint of the conductive solder contact layer may have substantially the same shape as a footprint of the patch radiator on which the parasitic radiating element is mounted.

In some embodiments, the active antenna array may further include a dielectric cover on the parasitic radiating elements opposite the patch radiators.

In some embodiments, the dielectric cover may be attached to the solder mask and/or the parasitic radiators via an adhesive layer.

In some embodiments, underneath each of the patch radiators a first opening may extend through the dielectric substrate and a second opening may extend through the ground plane and connect to the first opening.

In some embodiments, a first coefficient of thermal expansion of each parasitic radiator dielectric substrate may differ from a second coefficient of thermal expansion of the dielectric substrate by at least 100%.

In some embodiments, each combination of a patch radiator and the portion of the dielectric substrate and the ground plane below the patch radiator may comprise a patch radiating element, and the combination of each patch radiating element and a respective parasitic radiating element mounted thereon may comprise a stacked patch radiating element.

In some embodiments, the active antenna array may further include a plurality of dummy stacked patch radiating elements, each dummy stacked patch radiating element being substantially identical to an adjacent stacked patch radiating element except that a patch radiator of each dummy stacked patch radiating element is not connected to the feed network. In some embodiments, the vent hole is not plated with metal.

DETAILED DESCRIPTION

Figure 1:
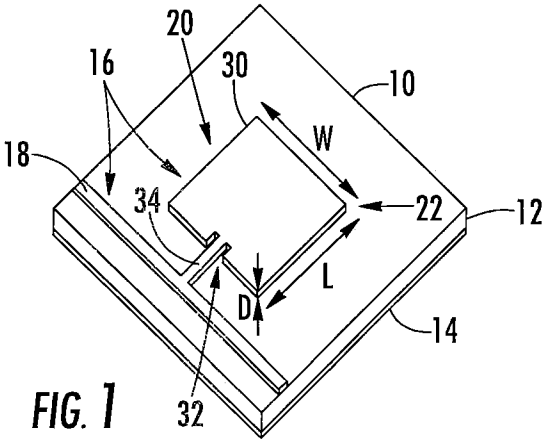
FIG. 1 is a schematic perspective view of a conventional patch radiating element.

Beamforming antennas are typically implemented as phased arrays of radiating elements. The size of the radiating elements, and the distance between adjacent radiating elements, are typically proportional to the "operating" frequency at which the radiating elements are designed to transmit and receive signals, with higher operating frequencies corresponding to smaller radiating elements and closer spacing between adjacent radiating elements. At frequencies below 1 GHz, typical radiating elements may be 4-8 inches long. At 60 GHz, the radiating elements may be sixty times smaller. When the radiating elements are this small, it may be possible to form the radiating elements on the same wiring boards (or other mounting substrates or structures) as active components of the communications system (e.g., transceivers, amplifiers, mixers, local oscillators and the like), resulting in a compact, low cost, and easy to assemble device. Implementing the active components and the radiating elements on the same mounting substrate may also reduce or eliminate the need for cables and connectors, which may simplify manufacturing, reduce transmission losses and eliminate potential sources of passive intermodulation distortion and antenna failures (e.g., bad solder joints, broken connections, etc.).

Microstrip patch antennas are a good candidate for phased array antennas that are implemented on the same substrate as other electronics, due to their planar form factor and ease of fabrication with normal printed circuit board manufacturing techniques. Conventional single-layer edge-fed patch radiating elements, however, have a high input impedance, and hence it may be difficult to match such patch radiating elements to the 50 ohm transmission feed lines that are commonly used in the feed networks for such antennas, particularly for applications having large transmission bandwidths. In other words, edge-fed patch radiating elements may inherently have a narrow impedance bandwidth, which may make them unsuitable for wideband applications, as the poor impedance match may result in reduced gain and/or increased sidelobe levels. A technique to improve the impedance match is to inset the feed point of the patch radiating element to a more central portion of the patch radiating element (instead of the edge), but this technique may only work over a narrow bandwidth due to reactance variation, and too much inset can degrade the radiation performance of the patch radiating element.

For an active phased array antenna (also referred to herein as an "active antenna array") in which the electronics and microstrip patch radiating elements are implemented on the same substrate, a thin substrate having a moderate dielectric constant value (e.g., a dielectric constant value of ~3-4) may be desirable for purposes of having transmission feed lines for the patch radiating elements that have reasonable line widths. However microstrip patch radiating elements desire electrically thicker and lower dielectric constant substrates for optimum bandwidth (e.g., a dielectric constant value of ~1-2). Thus, an inherent tradeoff may exist between the return loss performance and bandwidth of an active antenna array.

Stacked patch radiating elements can be used to increase the bandwidth over which an acceptable impedance match may be achieved. A "stacked patch radiating element" refers to a multi-layer patch radiating element that includes both a conventional patch radiating element that is fed by a transmission line along with a "parasitic" (i.e., not driven) radiating element that is suspended above the patch radiating element. One way of implementing a stacked patch radiating element is to implement both the patch radiating element and the parasitic radiating element on two different layers of a printed circuit board. Additional ways of implementing a stacked patch radiating element are to (1) adhesively bond a low dielectric constant foam spacer to the upper surface of the patch radiating element and to bond the parasitic radiating element to the other side of the foam and (2) using a secondary dielectric support structure to mount the parasitic radiating element above the patch radiating element with an air gap therebetween.

Unfortunately, at millimeter wave frequencies, a multi-layer printed circuit board with stacked patch radiating elements may exhibit increased insertion losses, and the use of low dielectric constant foam spacers or secondary dielectric support structures may require very tight tolerances when implemented at millimeter wave frequencies and/or may degrade other performance parameters such as impedance match, cross-polarization performance and/or radiation pattern shape. Additionally, at millimeter wave frequencies, there may be very little physical room for the secondary dielectric support structures. For example, a 28 GHz active antenna array with 60 degree azimuth scan may require a center-to-center distance between patch radiating elements of about 5-6 millimeters. However, each patch radiating element may be about 3 millimeters per side, and room is also required on the substrate for the feeding lines, leaving very little room for additional mechanical support structures.

Pursuant to embodiments of the present invention, pick-and-place stacked patch radiating elements are provided that may provide significantly improved performance and that may be readily manufactured, even when used in small form-factor millimeter wave phased array antennas. The pick-and-place stacked patch radiating elements according to embodiments of the present invention may comprise a conventional patch radiating element with a parasitic radiating element soldered to the top surface thereof. The parasitic radiating element may comprise, for example, a diced piece of a printed circuit board that has metallization on the top and bottom surfaces thereof. A solder mask may optionally be placed around the conventional patch radiating element, and solder may then be deposited on the upper surface of the conventional patch radiating element. Pick-and-place surface mount equipment may be used to place a parasitic radiating element on each patch radiating element. The parasitic radiating element may be self-aligning on the patch radiating element, both in terms of aligning the centers of the patch and parasitic radiators included on the respective patch and parasitic radiating elements and in terms of rotational symmetry. As a result, the parasitic radiating elements may be mounted on the respective patch radiating elements with a high degree of accuracy.

According to some embodiments of the present invention, stacked patch radiating elements are provided that include a dielectric substrate having first and second opposed surfaces, a ground plane on the first surface of the dielectric substrate, a patch radiator on the second surface of the dielectric substrate, a feed that is configured to connect the patch radiator to a transmission line, a solder layer on the patch radiator opposite the dielectric substrate, and a parasitic radiating element on the solder layer opposite the patch radiator. The parasitic radiating element includes a metal layer on the solder, a parasitic radiator dielectric substrate on the first metal layer opposite the solder, and a parasitic radiator on the parasitic radiator dielectric substrate opposite the first metal layer.

Pursuant to other embodiments, active antenna arrays are provided that include a base board having a dielectric substrate having first and second opposed surfaces, a ground plane on the first surface of the dielectric substrate, a plurality of patch radiators on the second surface of the dielectric substrate, and a plurality of feeds, each feed configured to connect a respective one of the patch radiators to one of a plurality of transmission lines of a feed network. These active antenna arrays further include a solder mask having a plurality of openings on the second surface of the dielectric substrate, solder within the openings in the solder mask, and a plurality of parasitic radiating elements on the solder. Each parasitic radiating element includes a parasitic radiator dielectric substrate having a first surface and a second surface opposite the first surface, a conductive solder contact layer on the first surface of the parasitic radiator dielectric substrate, and a parasitic radiator on the second surface of the parasitic radiator dielectric substrate.

According to still further embodiments of the present invention, methods of fabricating an array of stacked patch radiating elements are provided in which a substrate is provided that includes a plurality of patch radiators on an upper surface thereof. A solder mask is formed on the upper surface of the substrate, the solder mask including openings that expose the respective patch radiators. Solder-containing material is deposited on each of the patch radiators. Pick-and-place equipment is used to mount a plurality of parasitic radiating elements on respective ones of the patch radiators. Each parasitic radiating element comprises a parasitic radiator dielectric substrate that has a conductive solder contact layer on a first surface thereof and a parasitic metal layer on a second surface thereof that is opposite the first surface.

Embodiments of the present invention will now be discussed in further detail with reference to the attached drawings.

FIG. 1 is a perspective view of a conventional patch radiating element 20. As shown in FIG. 1, the conventional patch radiating element 20 is formed in a mounting substrate 10. The mounting substrate 10 comprises a dielectric substrate 12 having lower and upper major surfaces, a conductive ground plane 14 that is formed on the lower major surface of the dielectric substrate 12 and a conductive pattern 16 that is formed on the upper surface of the dielectric substrate 12 opposite the conductive ground plane 14. The patch radiating element 20 comprises a patch radiator 30 that is part of the conductive pattern 16, as well as the portion 22 of the dielectric substrate 12 that is below the patch radiator 30 and the portion of the conductive ground plane 14 that is below the patch radiator 30 (not visible in FIG. 1). A feed line 34 is coupled to the patch radiator 30. The feed line 34 may connect the patch radiating element 20 to a transmission line 18 such as, for example, a transmission line that is part of a feed network. The feed line 34 and the transmission line 18 are part of the conductive pattern 16 that is formed on the upper surface of the dielectric substrate 12.

The dielectric substrate 12 may comprise a planar sheet of dielectric material. A thickness and/or dielectric constant of the dielectric material may be selected based on a desired width of the feed line 34 and the transmission line 18 connected thereto, as well as the desired bandwidth for the patch radiating element 20. As shown in FIG. 1, the dielectric substrate 12 may include elements in addition to the patch radiating element 20 formed therein and/or mounted thereon such as, for example, the transmission line 18 and/or surface mount active components (not shown).

The ground plane 14 may comprise a continuous or discontinuous metal layer (e.g., a copper layer) that is formed on the lower surface of the dielectric substrate 12. In some embodiments, the ground plane 14 may include one or more openings therein. For example, in a probe-fed patch radiating element, an opening extends through the ground plane 14 and the dielectric substrate 12. A conductive probe (not shown) is inserted into this opening and is coupled to the patch radiator 30 (either galvanically or capacitively). The probe is used in place of the feed line 34 shown in FIG. 1 to couple RF signals between the patch radiator 30 and the transmission line 18. Probe-fed patch radiating elements may exhibit improved performance as compared to edge-fed patch radiating elements because the provision of the probe allows an RF signal to couple to the patch radiator 30 at an ideal location for impedance matching purposes, which is typically about halfway between a center of the patch radiator 30 and an edge of the patch radiator 30. Probe-fed patch radiating elements, however, may be more expensive to manufacture than an edge-fed patch radiating element such as the patch radiating element 20 illustrated in FIG. 1.

The patch radiator 30 may comprise a thin metal layer (e.g., copper) that is formed on the upper surface of the dielectric substrate 12 opposite the ground plane 14. The patch radiator 30 may have any appropriate shape including square, circular, rectangular, elliptical, etc. In some embodiments, the length L and width W of the patch radiator 30 may each be about a half of a wavelength of a center frequency of the frequency band in which the patch radiating element 20 is designed to operate. The length L and width W may be substantially larger than a thickness or "depth" D of the patch radiator 30.

The patch radiator 30 includes an inset feed design. With an inset feed design, a portion along a first side of a patch radiator 30 (assuming here a square or rectangular patch radiator that has "sides") is removed (or not formed) to create a recess 32 in the first side. The feed line 34 connects to the patch radiator 30 within this recess 32 so that the connection point between the feed line 34 and the patch radiator 30 appears to be within an "interior" of the patch radiator 30 where it is closer to the above-described ideal feed point. Use of an inset feed design improves the impedance match between the patch radiator 30 and the feed line 34, improving the return loss performance of the patch radiating element 20. Moderate insetting of the feed point typically has little impact on the radiation pattern of the patch radiating element 20. Moreover, the amount of inset (i.e., how far into the interior of the patch radiator 30 the feed point is inset) may be varied to trade-off the improvement in impedance match versus the impact on the radiation pattern of the patch radiating element 20. The patch radiating element 20 may be referred to herein as a "single-layer" patch radiating element to distinguish it from stacked patch radiating element designs (discussed below) that include multiple layers of radiating elements.

Figure 2A:
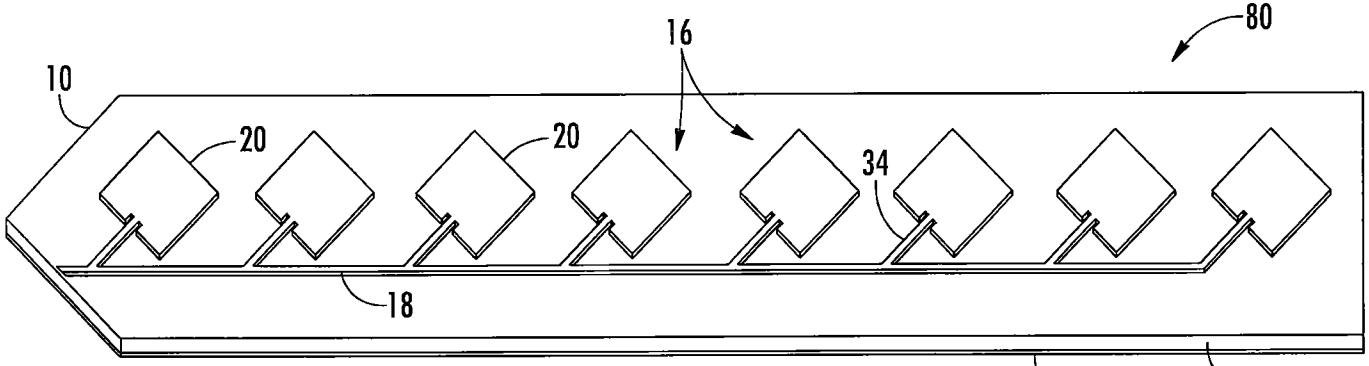
FIG. 2A is a schematic perspective view of a linear array that includes eight conventional patch radiating elements.

FIG. 2A is a schematic perspective view of a linear array 80 that includes eight conventional single-layer patch radiating elements 20. As shown in FIG. 2A, the patch radiating elements 20 are formed in the mounting substrate 10. The dielectric substrate 12 of the mounting substrate 10 acts as the dielectric substrate 20 for each of the patch radiating elements 20, and the conductive ground plane layer 14 on the lower surface of the dielectric substrate 12 that acts as the ground plane for each of the patch radiating elements 20. The metal pattern 16 on the upper surface of the dielectric substrate 12 includes eight patch radiators 30, eight corresponding feed lines 34 of each of the patch radiating elements 10, and a transmission line 18 that connects to each of the feed lines 34 to commonly feed the eight patch radiating elements 20.

Figure 2B:
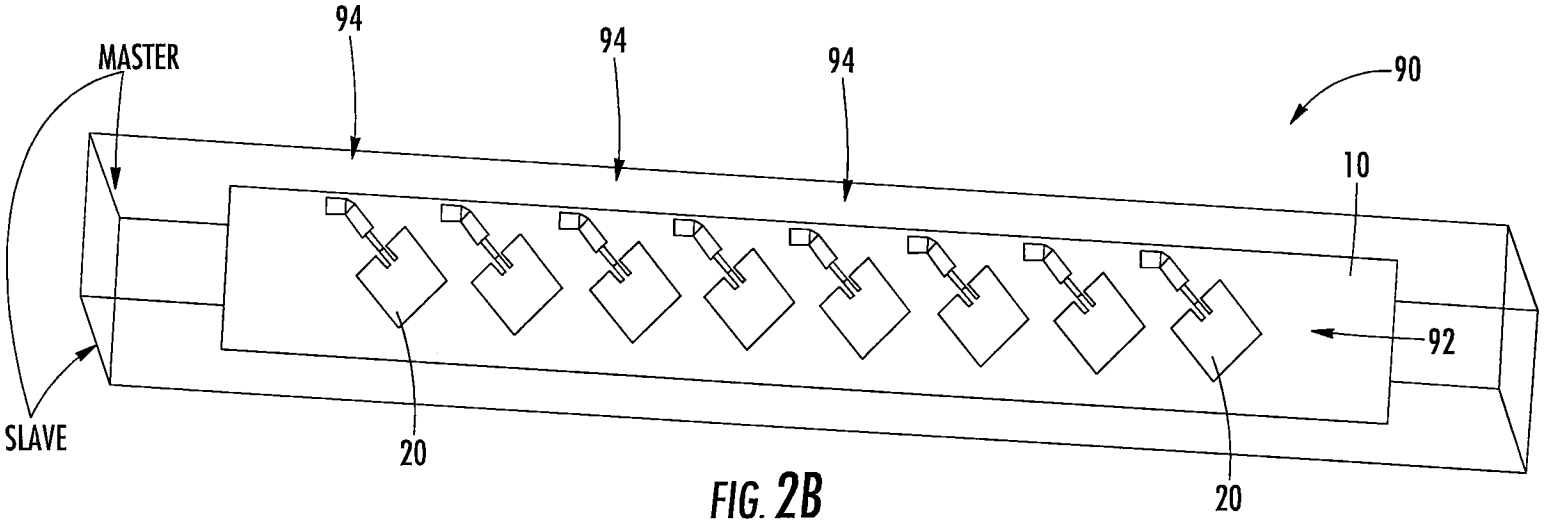
FIG. 2B is a schematic perspective view of a unit cell that was used in an HFSS model to simulate the column active reflection coefficient performance of an eight column antenna array of the conventional patch radiating elements of FIG. 2A.

Ansys High Frequency Structural Simulator ("HFSS") software was used to simulate the column active reflection coefficient performance of an eight column antenna array of the conventional patch radiating elements 20 that are included in the linear array 80 of FIG. 2A. In order to reduce the simulation time that would be necessary to simulate an 8×8 planar array of the conventional radiating elements 20, a unit cell HFSS model was used. FIG. 2B illustrates the unit cell 90 that was used in the HFSS model. As shown in FIG. 2B, the unit cell 90 includes one row 92 of eight conventional patch radiating elements 20. In the HFSS model, it is assumed that an infinite number of rows 92 are included in the antenna array so that the modelled antenna array is an ∞×8 element antenna array. Thus, each column in the modelled antenna array looks like the linear array 80 of FIG. 2A, except that the column (linear array) includes an infinite number of patch radiating elements 20 instead of eight patch radiating elements 20 as shown in FIG. 2A. The HFSS simulation model was programmed to apply the master/slave periodic boundaries in the elevation plane (with zero phase difference) to calculate the active impedance seen by an interior patch radiating element 20 in a large antenna array. In other words, a master/slave boundary condition was used in place of the eight radiating elements that would be provided in each column of an 8×8 array of the patch radiating elements 20.

Using the above HFSS simulation model, the column active reflection coefficient was simulated as a function of frequency across a 27.5-28.35 GHz operating frequency band for each of three different scan angles when the active antenna array was scanned in the azimuth plane to steer the antenna beam to different azimuth pointing directions. As noted above, in these simulations, conditions were set as if the active antenna array included eight vertical linear arrays each of which included an infinite number of patch radiating elements 20, where each of the eight linear arrays was fed by a separate transceiver. Periodic master/slave boundary conditions were set for a broadside elevation scan. The vertical spacing between horizontal "rows" of the antenna array was assumed to be 6.70 mm, which corresponds to a full guided wavelength at the center frequency of the 27.5-28.35 GHz operating frequency band. Accordingly, in a physical implementation of the simulation, adjacent patch radiating elements 20 in a column are fed with sub-components of an RF signal that are 360 degrees offset in phase, so that these sub-components will constructively combine. The horizontal spacing between the eight vertical columns of the antenna array was assumed to be 5.50 mm to allow scanning to 60 degrees in the azimuth plane.

The dielectric substrate 12 was assumed to be a 10 mil thick (i.e., 10 mils in the depth direction D) Rogers RO3003 dielectric substrate having a dielectric constant of about 3.0. A thicker dielectric substrate 12 having a lower dielectric constant would be desired to improve the bandwidth of the patch radiating element 20. However, in order to form the patch radiating element 20 on the same mounting substrate 10 as other components of an active antenna array, the thinner 10 mil thick dielectric substrate 12 having a higher than ideal dielectric constant is used in order to allow use of 50 Ohm transmission line traces having reasonable widths for the surface mounted devices required by the actively scanned array.

Figure 3A:
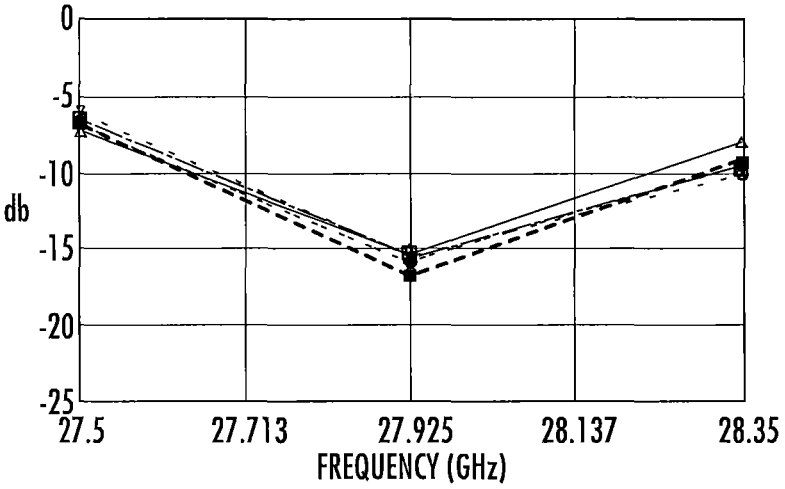
FIGS. 3A-3C are graphs illustrating the simulated column active reflection coefficient as a function of frequency and azimuth antenna beam scanning angle for an eight column antenna array of conventional patch radiating elements.
Figure 3B:
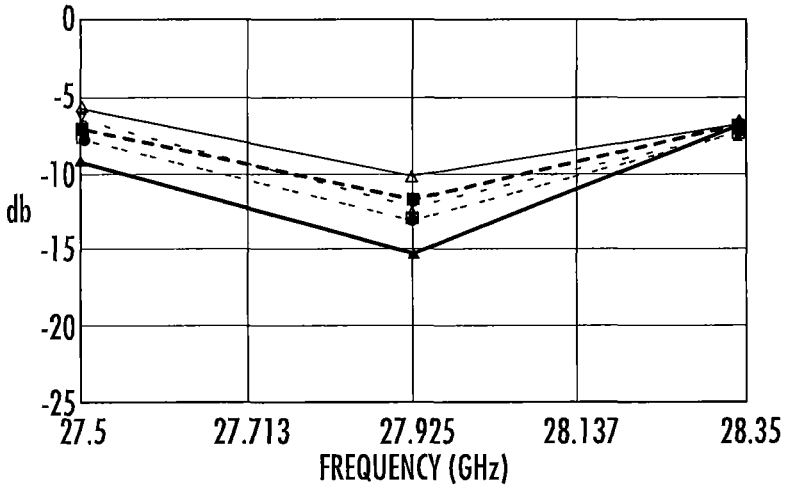
Figure 3C:
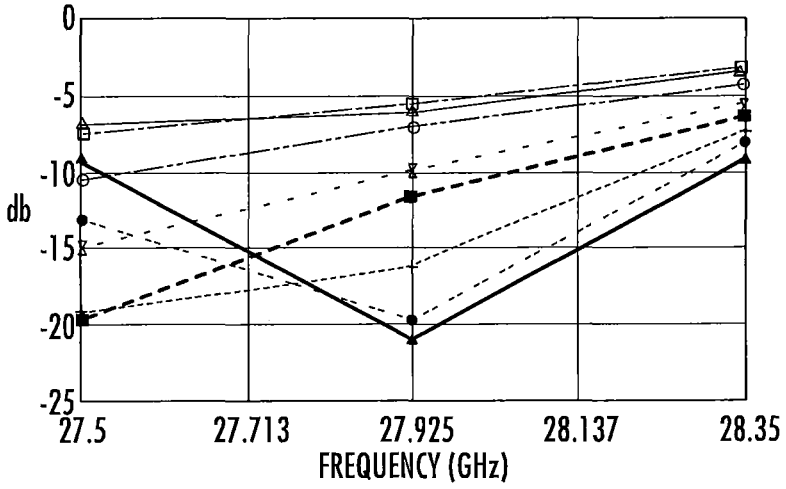

FIGS. 3A-3C are graphs illustrating the simulated column active reflection coefficient as a function of frequency and azimuth antenna beam scanning angle obtained from the above-described HFSS simulation. In particular, FIG. 3A illustrates the simulated column active reflection coefficient when the antenna beam formed by the eight column antenna array is pointed at the boresight pointing direction of the active antenna array, FIG. 3B illustrates the simulated column active reflection coefficient when the antenna beam formed by the eight column antenna array is scanned 30 degrees off boresight in the azimuth plane, and FIG. 3C illustrates the simulated column active reflection coefficient when the antenna beam formed by the eight column antenna array is scanned 60 degrees off boresight in the azimuth plane. Here, the design goal was a column active reflection coefficient of less than −10 dB across the entire operating frequency band (27.5-28.35 GHz) at azimuth scan angles of up to 60 degrees. Eight different curves are plotted in FIGS. 3A-3C which illustrate the column active reflection coefficient performance for each of the eight columns of the active antenna array. As can be seen, the column active reflection coefficient performance may vary significantly based on the position of the columns within the active antenna array, particularly at high azimuth beam-scanning angles.

As can be seen from FIG. 3A, even without beam scanning, the active antenna array maintains an active reflection coefficient level of less than the design goal of −10 dB for only about 50% of the operating frequency band, and active reflection coefficient levels of as high as −5 to −6 dB are incurred at the outer edges of the operating frequency band.

As shown in FIG. 3B, when the antenna beam is scanned 30 degrees in the azimuth plane, the frequency range that meets the design goal is reduced significantly, with only frequencies near the center of the band maintaining an active reflection coefficient level of less than −10 dB. One of the columns only meets the design goal for active reflection coefficient in the center of the operating frequency band. Performance at the edges of the operating frequency band is similar to the performance shown in FIG. 3A.

As shown in FIG. 3C, when the antenna beam is scanned 60 degrees in the azimuth plane, the design goal for active reflection coefficient performance is not consistently met anywhere within the operating frequency band, and the active reflection coefficient levels increase dramatically. The results shown in FIGS. 3A-3C show that an active antenna array formed using eight columns of conventional patch radiating elements 20 may not provide acceptable return loss performance.

For an active antenna array that operates at millimeter wave frequencies such as, for example, 28 GHz, in which the patch radiating elements and other electronic components are implemented on a common mounting substrate, a relatively thin dielectric substrate (e.g., 10 mils thick) having a moderate dielectric constant (e.g., a dielectric constant of about 3-4) may be desired so that the feed line 34 and transmission line 18 may have reasonable widths for interfacing with the other surface mounted packaged electronic components while still providing a good impedance match between the feed line 34 and the patch radiator 30. However, for purposes of increasing the transmission bandwidth of the patch radiating element 20, it may be desirable to use thicker dielectric substrates 12 and/or dielectric substrates having a lower dielectric constant (e.g., a dielectric constant of about 1-2). Thus, conventional single-layer microstrip-implemented patch radiating elements such as the patch radiating element 20 of FIG. 1 may have inherent limitations.

A known technique to improve the bandwidth of a patch radiating element 20 is to stack an additional radiating element that is not coupled to the feed network above the conventional patch radiator 30 of the patch radiating element 20. Such a radiating element is commonly referred to as a "stacked" patch radiating element. In a stacked patch radiating element, the patch radiator 30 may sometimes be referred to as the "driven" patch radiator 30 as the patch radiator 30 is coupled to a feed network so that RF signals can be provided to patch radiator 30 for transmission, and so that received RF signals may be passed from the patch radiating element 20 to a feed network that is connected to a receiver of a radio. The additional radiating element in a stacked patch radiating element is typically referred to as a parasitic radiating element.

The provision of the parasitic radiating element in a stacked patch radiating element may improve the "scan" impedance bandwidth as compared to that of a single-layer patch radiating element. The "scan impedance bandwidth" refers to the operating frequency range over which an antenna array can scan the antenna beam off of boresight while maintaining a certain level of return loss performance. The parasitic radiating element may include a parasitic radiator that is sized or otherwise tuned to resonate at a different frequency than the patch radiator of the patch radiating element to provide this increase in the scan impedance bandwidth.

Figure 4A:
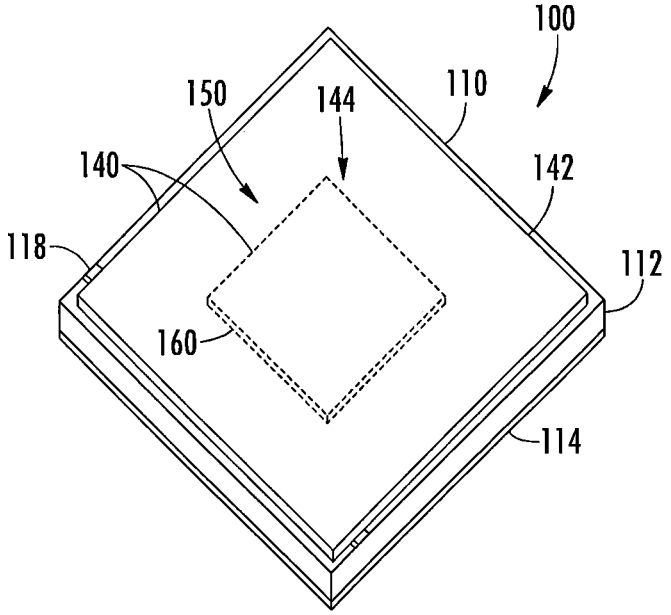
FIG. 4A is a schematic perspective view of a conventional stacked patch radiating element.

FIG. 4A is a perspective view of conventional stacked path radiating element 100. The conventional stacked path radiating element 100 includes a patch radiating element 120 and a parasitic radiating element 150, as explained in further detail below.

Figure 4B:
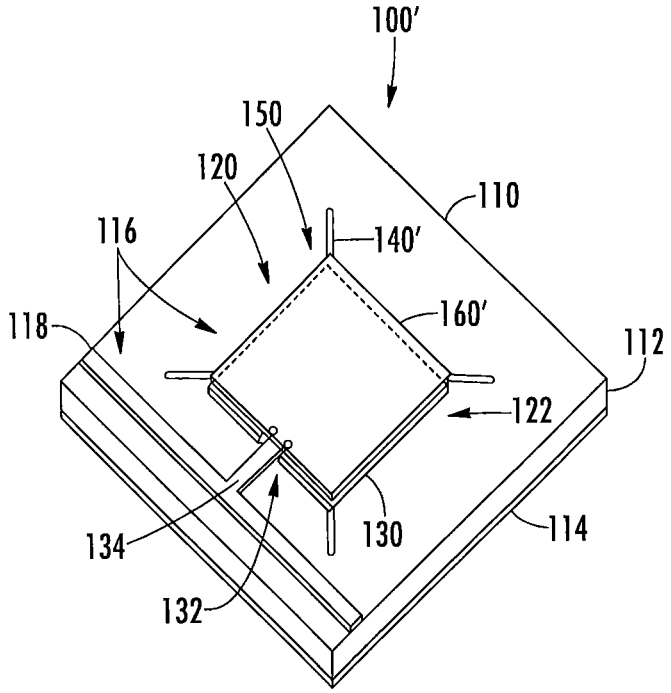
FIG. 4B is a schematic perspective view of another conventional stacked patch radiating element.

As shown in FIG. 4A, the conventional stacked patch radiating element 100 includes a patch radiating element 120 (see FIG. 4B) that is formed in a mounting substrate 110. The mounting substrate 110 comprises a dielectric substrate 112 having lower and upper major surfaces, a conductive ground plane 114 that is formed on the lower major surface of the dielectric substrate 112 and a conductive pattern 116 that is formed on the upper surface of the dielectric substrate 112 opposite the conductive ground plane 114. The patch radiating element 120 comprises a patch radiator 130 that is part of the conductive pattern 116, as well as the portion 122 of the dielectric substrate 112 that is below the patch radiator 130 and the portion of the conductive ground plane 114 that is below the patch radiator 130 (not visible in FIG. 4A). The patch radiating element 120 (including the patch radiator 130) is hidden from view in FIG. 4A, but may be identical to the patch radiating element 30 shown in FIG. 1 and can be seen in the modified version of the stacked patch radiating element 100 that is shown in FIG. 4B. A feed line 134 is coupled to the patch radiator 130 (also not visible in FIG. 4A, but can be seen in FIG. 4B). The feed line 134 may connect the patch radiating element 120 to a transmission line 118 such as, for example, a transmission line that is part of a feed network. The feed line 134 and the transmission line 118 are also part of the conductive pattern 116 that is formed on the upper surface of the dielectric substrate 112

The dielectric substrate 112 may comprise a planar sheet of dielectric material. A thickness and/or dielectric constant of the dielectric material may be selected based on a desired width of the feed line 134 and the transmission line 118 connected thereto, as well as the operating bandwidth of the stacked patch radiating element 100. The ground plane 114 may comprise a continuous or discontinuous metal layer (e.g., a copper layer) that is formed on the lower surface of the dielectric substrate 112. In some embodiments, the ground plane 114 may include one or more openings therein to accept probe feeds in, for example, the manner discussed above with reference to FIG. 1.

The patch radiator 130 (see FIG. 4B) may comprise a thin metal layer (e.g., copper) that is formed on the second surface of the dielectric substrate 112 opposite the ground plane 114. The patch radiator 130 may have any appropriate shape including square, circular, rectangular, elliptical, etc. The length L, width W and depth D of the patch radiator 130 are defined in the same manner as shown above with respect to the patch radiator 30 of FIG. 1. In some embodiments, the length L and width W of the patch radiator 130 may each be about a half of a wavelength of a center frequency of the frequency band in which the stacked patch radiating element 100 is designed to operate. The length L and width W may be substantially larger than a thickness or depth D of the patch radiator 130. The patch radiator 130 includes a recess 132 (also not visible in FIG. 4A, but which may be identical to the recess 32 included in the patch radiator 30 of FIG. 1 and is partially visible in FIG. 4B) to allow for an inset feed design as described above with reference to the patch radiator 30 of FIG. 1. Accordingly, further description of the inset feed design will be omitted here.

As shown in FIG. 4A, the conventional stacked patch radiating element 100 further includes a parasitic radiating element 150 that is mounted above the "driven" patch radiating element 120. The parasitic radiating element 150 is formed in a parasitic mounting substrate 140. The parasitic mounting substrate 140 comprises a dielectric substrate 142 having opposed lower and upper major surfaces and a conductive pattern 144 (shown in dashed lines in FIG. 4A since it otherwise would not be visible) that is formed on the lower surface of the dielectric substrate 142. The parasitic radiating element 150 comprises a parasitic radiator 160 that is part of the conductive pattern 144. The portion of the dielectric substrate 142 that is above the parasitic radiator 160 may act as a dielectric cover.

Typically, the patch radiating element 120 is one of a plurality of patch radiating elements 120 that are included in an antenna array, as discussed above with respect to FIG. 2A (which illustrates a linear array 80 of eight patch radiating elements 20) and FIGS. 3A-3C (which discuss simulations performed on an eight column antenna array). Thus, while not shown in FIG. 4A, the mounting substrate 110 will typically include a plurality of radiating elements 120 formed therein, and the parasitic mounting substrate 140, which is implemented as a printed circuit board, will include a corresponding plurality of parasitic radiating elements 150 formed therein, where a parasitic radiating element 150 is provided for each patch radiating element 120 in the active antenna array. Each parasitic radiating element 150 is mounted above a respective one of the patch radiating elements 120.

In the embodiment of FIG. 4A, the parasitic mounting substrate 140 is mounted above the patch radiating elements 120 and is spaced apart from the patch radiating elements 120. In some embodiments, a sheet of low loss dielectric foam such as Rohacell (not shown in FIG. 4A) may be provided between the mounting substrate 110 and the parasitic mounting substrate 140 in order to support the parasitic mounting substrate 140 above the patch radiators 130. In other embodiments, a separate support structure (not shown) may be used to mount the parasitic mounting substrate 140 above the patch radiating elements 120 with an air gap between the patch radiators 130 and the parasitic radiators 160. The parasitic radiating element 150 comprises the parasitic radiator 160 and a parasitic radiator dielectric that comprises the dielectric material (either a portion of the low loss dielectric foam or the air gap) that is disposed between the parasitic radiator 160 and the patch radiator 130.

The shape of the parasitic radiator 160 may be similar to the shape of the patch radiator 130. The footprint of the parasitic radiator 160 (i.e., the outer periphery of the parasitic radiator 160 when viewed along an axis extending in the depth direction D of FIG. 1) may be somewhat different than (either larger or smaller) the footprint of the patch radiator 140, which may increase the operating bandwidth of the stacked patch radiating element 100 as compared to the single-layer patch radiating element 20 of FIG. 1.

FIG. 4B is a schematic perspective view of another conventional stacked patch radiating element 100'. The stacked patch radiating element 100' is very similar to the stacked patch radiating element 100 discussed above, except that the parasitic mounting substrate 140 that includes the dielectric substrate 142 having the parasitic radiator 160 formed on a lower surface thereof that is included in the stacked patch radiating element 100 is replaced with a dielectric support structure 140' and a parasitic radiator 160' in the stacked patch radiating element 100'. The parasitic radiator 160' may comprise a thin sheet of metal. The dielectric support structure 140' is shown schematically in FIG. 4B as four plastic supports that have base ends mounted on the dielectric substrate 112 and distal ends that are attached to the corners of the parasitic radiator 160'. The dielectric support structure 140' may hold the parasitic radiator 160' above the patch radiator 130. The patch radiator 130 is spaced apart from the parasitic radiator 160' by an air gap which serves as a parasitic radiator dielectric. With respect to the stacked patch radiating element 100' of FIG. 4B, the patch radiator 130 is spaced apart from the parasitic radiator 160' by 0.75 mm. Any appropriate dielectric support structure 140' may be used that is capable of holding the parasitic radiator 160' above the patch radiator 130 with an air gap in between.

Figure 5A:
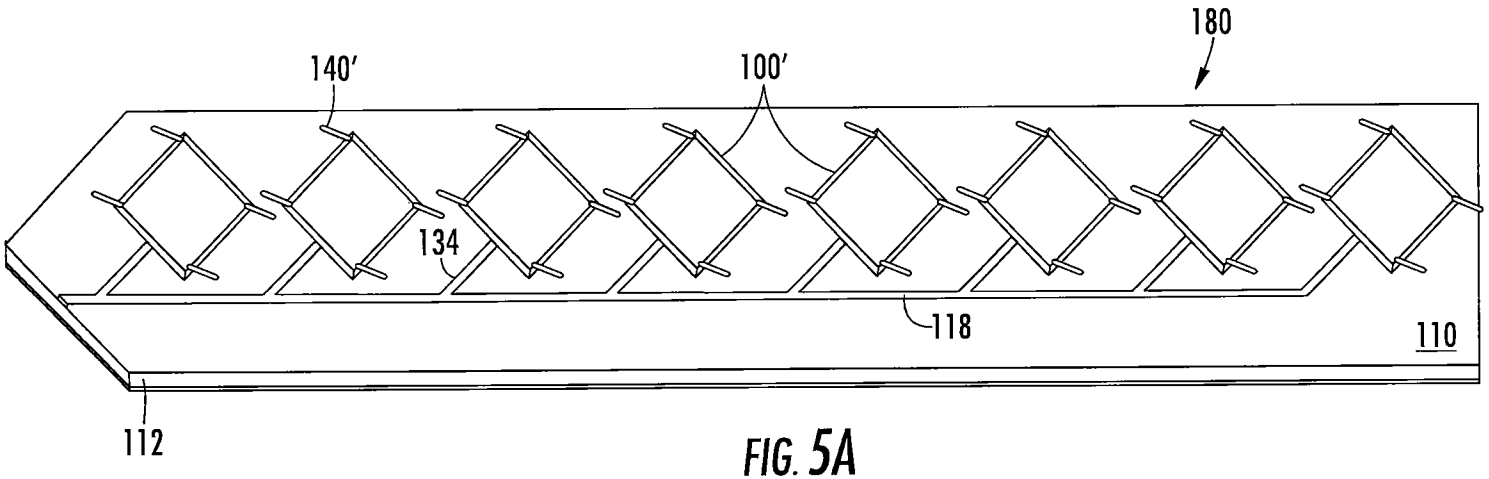
FIG. 5A is a schematic perspective view of a linear array that includes eight conventional stacked patch radiating elements.

FIG. 5A is a schematic perspective view of a linear array 180 that includes eight of the conventional stacked patch radiating elements 100' of FIG. 4B. As shown in FIG. 5A, the linear array 180 is similar to the linear array 80 of eight conventional single-layer patch radiating elements 20 discussed above with reference to FIG. 2A, except that each single-layer patch radiating element 20 is replaced with one of the stacked patched radiating elements 100' described above with reference to FIG. 4B. Given the similarity between FIGS. 2A and 5A, further description of FIG. 5A will be omitted here.

Figure 5B:
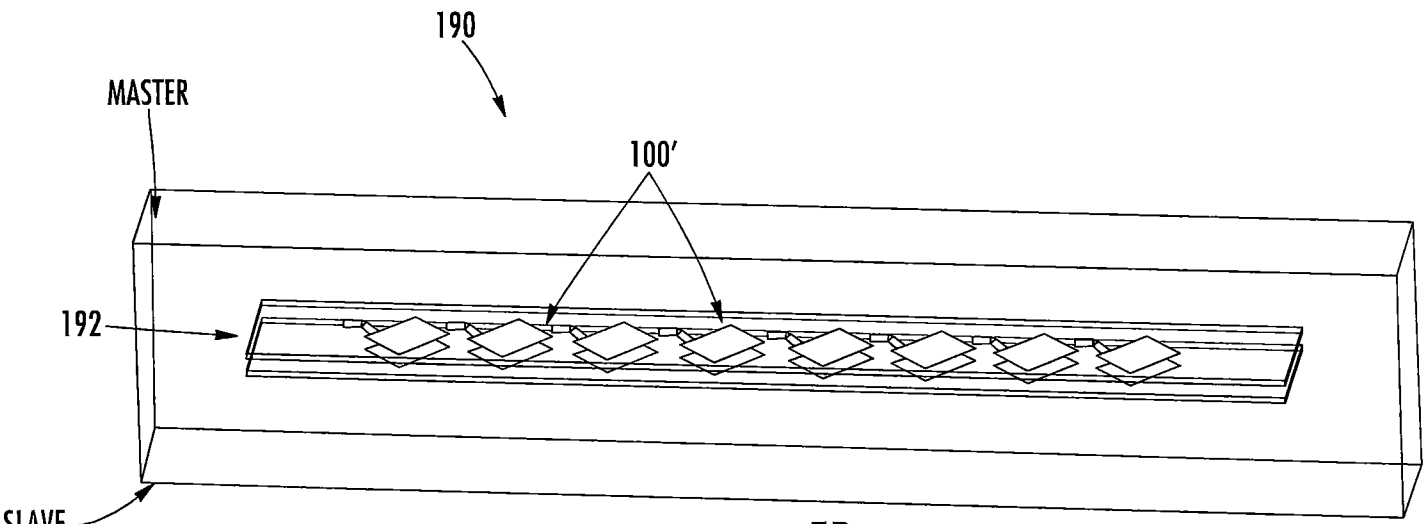
FIG. 5B is a schematic perspective view of a unit cell that was used in an HFSS model to simulate the column active reflection coefficient performance of an eight column antenna array of the conventional stacked patch radiating elements of FIG. 5A.

HFSS was again used simulate the column active reflection coefficient performance of an eight column antenna array of the conventional patch radiating elements 100' that are included in the linear array 180 of FIG. 5A. Once again, in order to reduce the simulation time that would be necessary to simulate and 8×8 planar array of the conventional stacked radiating elements 100', a unit cell HFSS model was used. FIG. 5B illustrates the unit cell 190 that was used in the HFSS model. As shown in FIG. 5B, the unit cell 190 includes one row 192 of eight conventional patch radiating elements 100', and the model assumed that an infinite number of the rows 192 were included in the antenna array. The simulation performed using the unit cell of FIG. 5B used the same design assumptions discussed above with reference to FIGS. 2B and 3A-3C.

Figure 6A:
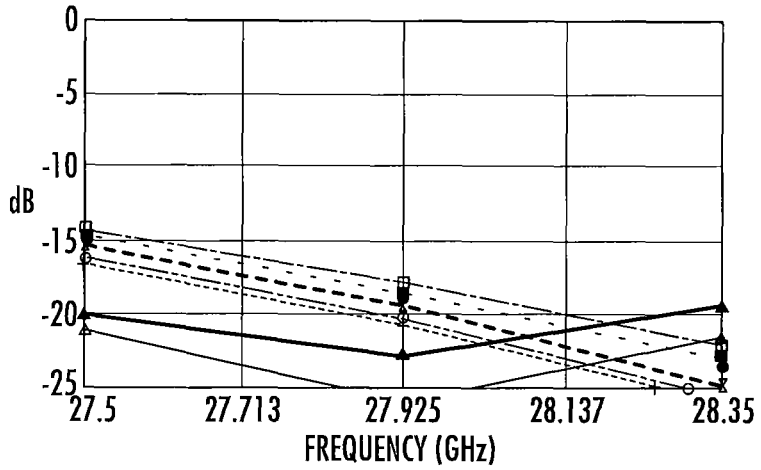
FIGS. 6A-6C are graphs illustrating the simulated column active reflection coefficient as a function of frequency and azimuth antenna beam scanning angle for an eight column antenna array of conventional stacked patch radiating elements.
Figure 6B:
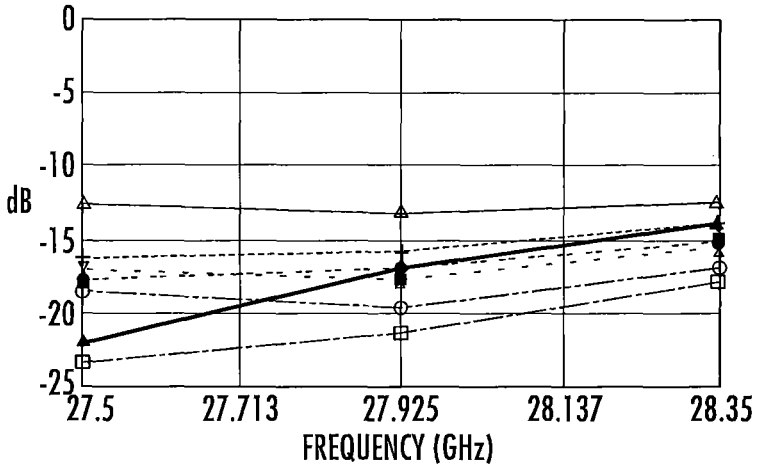
Figure 6C:
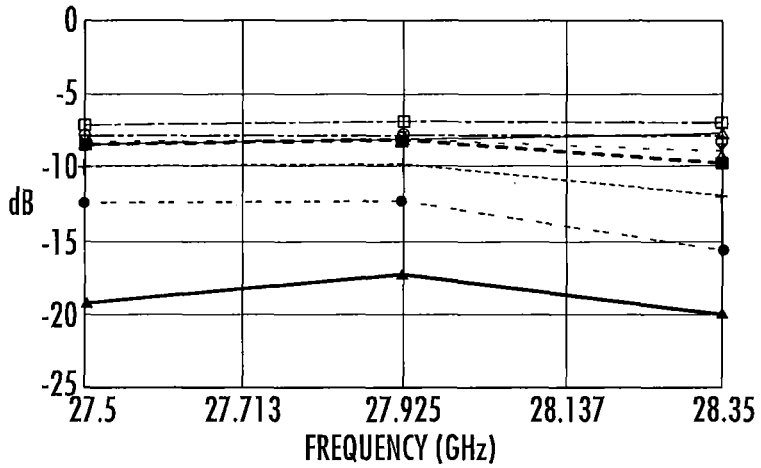

FIGS. 6A-6C are graphs illustrating the simulated column active reflection coefficient as a function of frequency and azimuth antenna beam scanning angle for an eight column antenna array that were obtained from the above-described simulation. In particular, FIG. 6A illustrates the simulated column active reflection coefficient when the antenna beam is pointed at the boresight pointing direction of the active antenna array, FIG. 6B illustrates the simulated column active reflection coefficient when the antenna beam is scanned 30 degrees in the azimuth plane, and FIG. 6C illustrates the simulated column active reflection coefficient when the antenna beam is scanned 60 degrees in the azimuth plane. As with FIGS. 3A-3C, eight different curves are plotted in FIGS. 6A-6C to illustrate the column active reflection coefficient performance for the eight different linear arrays 180 in the active antenna array.

As can be seen from FIG. 6A, when the beam is not scanned, the antenna array of conventional stacked patch radiating elements 100' easily met the design goal of less than −10 dB column active reflection coefficient across the entire operating frequency band. The column active reflection coefficient is asymmetric with respect to frequency, with improved column active reflection coefficient performance at the higher frequencies in the operating frequency band.

As shown in FIG. 6B, when the antenna beam is scanned 30 degrees in the azimuth plane, the design goal for column active reflection coefficient performance is again met across the entire operating frequency band, with at least nearly 3 dB of margin at all frequencies.

As shown in FIG. 6C, when the antenna beam is scanned 60 degrees in the azimuth plane, the design goal for column active reflection coefficient performance is not consistently met anywhere within the operating frequency band, and the active reflection coefficient levels increase dramatically from that shown in FIGS. 6A-6B. The results shown in FIG. 6C show that an array of conventional stacked patch radiating elements 100' may not meet the design goals for return loss performance. While further optimization could potentially meet the design goal for return loss, there are substantial mechanical challenges in implementing the stand-off structures that support the parasitic radiators 160, 160' included in the stacked patch radiating elements 100, 100' of FIGS. 4A-4B. Required tolerances may be +/−0.1 mm for performance repeatability in volume production, which may be difficult and/or expensive to achieve.

As described above, pursuant to embodiments of the present invention stacked patch radiating elements are provided that may exhibit improved performance as compared to conventional single-layer patch radiating elements. The stacked patch radiating elements according to embodiments of the present invention may also avoid the significant mechanical challenges that may be present in attempting to implement an antenna array of conventional stacked patch radiating elements that is designed to operate in the millimeter wave frequency band. Moreover, because the stacked patch radiating elements according to embodiments of the present invention may have one or more additional degrees of design freedom as compared to conventional stacked patch radiating elements, the stacked patch radiating elements according to embodiments of the present invention may also exhibit improved performance as compared to conventional stacked patch radiating elements.

Figure 7A:
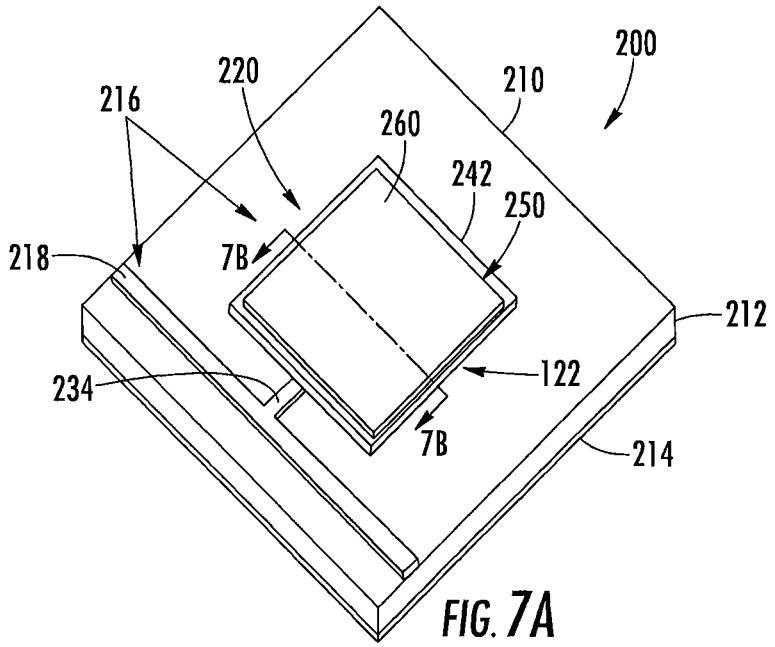
FIG. 7A is a perspective view of a pick-and-place stacked patch radiating element according to embodiments of the present invention.
Figure 7B:
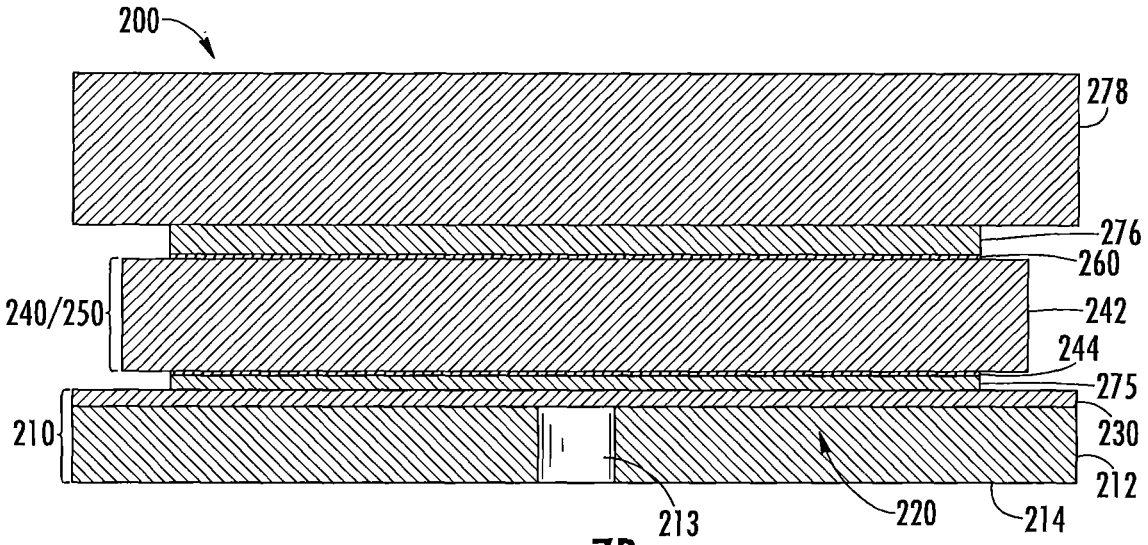
FIG. 7B is a cross-sectional view taken along lines 7B-7B of FIG. 7A.
Figure 7C:
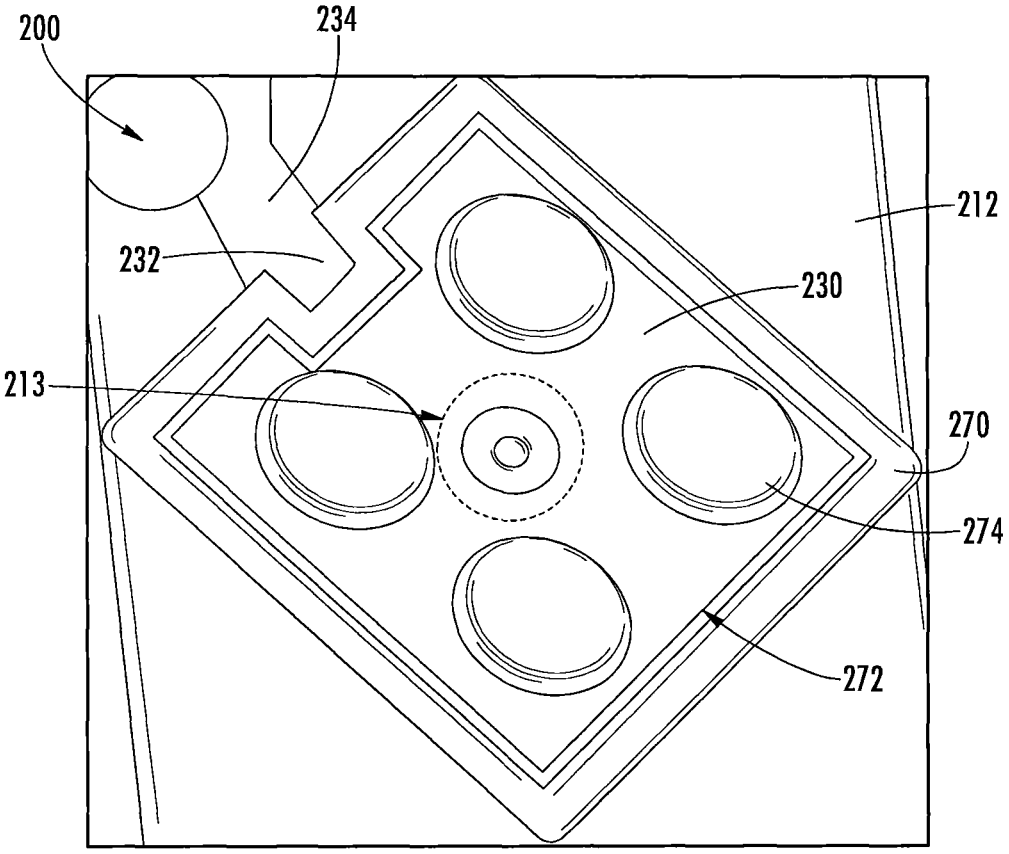
FIG. 7C is a perspective view of one of the pick-and-place stacked patch radiating elements according to embodiments of the present invention during an intermediate fabrication step.

FIGS. 7A-7C illustrates a pick-and-place stacked patch radiating element 200 according to embodiments of the present invention. In particular, FIG. 7A is a perspective view of the pick-and-place stacked patch radiating element 200, FIG. 7B is a cross-sectional view taken along lines 7B-7B of FIG. 7A, and FIG. 7C is a perspective view of the pick-and-place stacked patch radiating element 200 during an intermediate fabrication step.

As shown in FIG. 7A-7C, the pick-and-place stacked patch radiating element 200 according to embodiments of the present invention includes a patch radiating element 220 and a parasitic radiating element 250. The patch radiating element 220 may have a generally conventional design. In particular, the patch radiating element 220 is formed in a mounting substrate 210. The mounting substrate 210 includes a dielectric substrate 212 having lower and upper major surfaces, a conductive ground plane 214 that is provided on the lower surface of the dielectric substrate 212 and a conductive pattern 216 that is provided on the upper surface of the dielectric substrate 212. The patch radiating element 220 comprises a patch radiator 230 (see FIG. 7C) that is part of the conductive pattern 216, as well as the portion 222 of the dielectric substrate 212 that is below the patch radiator 230 and the portion of the conductive ground plane 214 that is below the patch radiator 230. A feed line 234 is coupled to the patch radiator 230. The feed line 234 may be directly galvanically coupled to the patch radiator 230 (as shown in the example of FIGS. 7A-7C) or may be capacitively coupled to the patch radiator 230. The feed line 234 may connect the patch radiator 230 to a transmission line 218 such as, for example, a transmission line that is part of a feed network. The feed line 234 and the transmission line 218 are part of the conductive pattern 216 that is formed on the upper surface of the dielectric substrate 212.

The dielectric substrate 212 may comprise a planar sheet of dielectric material. A thickness and/or dielectric constant of the dielectric material may be selected based on a desired width of the feed line 234 and the transmission line 218 connected thereto, as well as the operating bandwidth of the patch radiating element 200. The ground plane 214 may comprise a continuous or discontinuous metal layer (e.g., a copper layer) that is formed on the lower surface of the dielectric substrate 212. In some embodiments, the ground plane 214 may include one or more openings therein to accept probe feeds in, for example, the manner discussed above with reference to FIG. 1. The ground plane 214 may also include openings therein that act as vent holes, as will be explained in further detail below.

The patch radiator 230 may comprise a thin metal layer (e.g., copper) that is formed on the upper surface of the dielectric substrate 212 opposite the ground plane 214. The patch radiator 230 may have any appropriate shape including square, circular, rectangular, elliptical, etc. The length L, width W and depth D of the patch radiator 230 are defined in the same manner as shown above with respect to the patch radiator 30 of FIG. 1. In some embodiments, the length L and width W of the patch radiating element may each be about a half of a wavelength of a center frequency of the frequency band in which the stacked patch radiating element 200 is designed to operate. The length L and width W may be substantially larger than a thickness or "depth" D of the patch radiator 230. The width W of the patch radiator 230 may be varied to improve the impedance match between the patch radiator 230 and the transmission line 218 and feed line 234. The length L of the patch radiator 230 may be varied to adjust the resonant frequency of the patch radiator 230.

The patch radiator 230 includes an inset feed design so that the patch radiator 230 has a recess 232 (see FIG. 7C) on one side thereof and the feed line 234 connects to the patch radiator 230 within the recess 232, as described above with reference to the patch radiator 30 of FIG. 1. In the depicted embodiment, the inset is not a full inset that extends to halfway between the edge of the patch radiator 230 and a center of the patch radiator 230, but instead extends a smaller distance into the center of the patch radiator 230. It will be appreciated that in other embodiments, the inset may extend further or may be omitted altogether. The "amount" of inset (i.e., how far the inset extends into the center of the patch radiator from the edge of the patch radiator) is a trade-off between the impedance match of the patch radiator 230 to the feed line 234 and transmission line 218 and the cross-polarization performance of the stacked patch radiating element 200.

As is further shown in FIGS. 7A-7C, the pick-and-place stacked patch radiating element 200 includes a parasitic radiating element 250 that is mounted on the patch radiating element 220. The parasitic radiating element 250 may comprise, for example, a small section of microstrip printed circuit board 240 (or other mounting substrate). The microstrip printed circuit board 240 comprises a parasitic radiator dielectric substrate 242 that has lower and upper major surfaces. A conductive solder contact layer 244 is provided on the lower surface of the parasitic radiator dielectric substrate 242. A parasitic radiator 260 is provided on the upper surface of the parasitic radiator dielectric substrate 242. The parasitic radiating element 250 comprises the conductive solder contact layer 244, the parasitic radiator dielectric substrate 242 and the parasitic radiator 260.

In some embodiments, the conductive solder contact layer 244 may have the same shape as the patch radiator 230, and may have the same footprint as the patch radiator 230. Thus, if the patch radiator 230 has a recess 232 to provide an inset-feed design, the conductive solder contact layer 244 may similarly include such a recess. The parasitic radiator 260 may (but need not) have a similar shape to the patch radiator 230 and may be spaced above the patch radiator 230 by a solder layer 275 (see discussion below), the conductive solder contact layer 244 and the parasitic radiator dielectric substrate 242. The parasitic radiator 260 may have a footprint that is somewhat different from the footprint of the patch radiator 230, which may increase the operating bandwidth of the pick-and-place stacked patch radiating element 200.

As will be apparent from the discussion below, the pick-and-place stacked patch radiating element 200 is one of a plurality of stacked patch radiating elements 200 that are included in an antenna array such as an active antenna array. Thus, while not shown in FIGS. 7A and 7B, the mounting substrate 210 will typically include a plurality of patch radiating elements 220 formed therein. However, individual parasitic radiating elements 250 are provided for (and mounted above) each patch radiating element 220 in the active antenna array, as discussed below.

FIG. 7C is a perspective view of one of the pick-and-place stacked patch radiating elements 200 according to embodiments of the present invention during an intermediate fabrication step. As shown in FIG. 7C, a solder mask 270 is formed on the upper surface of the dielectric substrate 212. The solder mask 270 includes an opening 272 that exposes an upper surface of one of the patch radiators 230. Solder-containing material 274 is deposited in the opening 272 in the solder mask 270, directly on top of the patch radiator 230. In an example embodiment, the solder-containing material 274 may be a solder paste that comprises, for example, small balls of solder contained in a flux material that renders the solder flowable at room temperature. The solder paste can then be heated to melt the solder balls and burn away the flux material to convert the solder paste into a molten solder layer 275. The solder mask 270 contains the molten solder layer 275 in a desired region on top of the parasitic radiator 230.

The parasitic radiating element 250 may be formed, for example, by depositing patterned metal layers on both upper and lower surfaces of a microstrip printed circuit board 240, where the patterned metal layer on the lower surface comprises a plurality of conductive solder contact layers 244 and the patterned metal layer on the upper surface comprises a plurality of parasitic radiators 260 that are above respective ones of the conductive solder contact layers 244. Scribe lines may be provided between adjacent conductive solder contact layers 244 and between adjacent parasitic radiators 260. The microstrip printed circuit board 240 may be sawed or otherwise diced or singulated to provide a plurality of parasitic radiating elements 250. After dicing, each parasitic radiating element 250 may be placed on an adhesive tape suitable for use with pick-and-place equipment.

Referring again to FIGS. 7B and 7C, a pick-and-place machine may be programmed to pick up a parasitic radiating element 250 from, for example, an adhesive tape and then place the parasitic radiating element 250 onto the solder containing material 274 (which is subsequently heated to a molten solder layer 275) that is included in one of the openings 272 in the solder mask 270. The molten solder may adhere to both the underlying patch radiating element 230 and to the conductive solder contact layer 244 of the parasitic radiating element 250, which after cooling bonds the parasitic radiating element 250 to the patch radiating element 220 to form the stacked patch radiating element 200.

When the pick-and-place machine sets a parasitic radiating element 250 on its corresponding patch radiating element 230, the conductive solder contact layer 244 of the parasitic radiating element 250 typically will not be perfectly aligned with the parasitic radiator 230. Alignment may be off in the length direction L and/or the width direction W, and the parasitic radiating element 250 may also not be rotationally aligned with the underlying patch radiator 230. The surface tension of the molten solder layer 275 may act to align the center of the conductive solder contact layer 244 with the center of the patch radiator 230, and may also rotationally self-align the conductive solder contact layer 244 with the underlying patch radiator 230. In some embodiments, to facilitate this alignment, each conductive solder contact layer 244 may be the same size and shape as the patch radiator 230 that it is mounted on. The solder may form a permanent physical and electrical (conductive) bond between the patch radiator 230 and the conductive contact metal layer 244. The combination of the patch radiator 230, the solder layer 275 thereon and the conductive solder contact layer 244 may thus together act as the driven radiator in the stacked patch radiating element 200 of FIGS. 7A-7C. The thickness of the patch radiator 230 may be reduced below the thickness of a conventional patch radiator in light of the extra metal layers formed thereon.

As is further shown in FIG. 7B, in some embodiments, a dielectric cover 278 may be mounted above the parasitic radiating element 250 using an adhesive 276 such as, for example, a double-sided adhesive tape such as the 300 LSE® double-sided adhesive sold by 3M® or a liquid adhesive such as Loctite®. The dielectric cover 278 and adhesive layer 276 are omitted in FIG. 7A to more clearly show other elements of the stacked patch radiating element 200. The dielectric cover 278 may be attached to the top metallization layer (i.e., the parasitic radiator 260) of the parasitic radiating element 250. The dielectric cover 278 may help further increase the impedance bandwidth in a manner similar to how a wide angle impedance matching sheet is applied to wide angle planar phased arrays. The dielectric cover 278 may be particularly helpful in improving the impedance match at wide scan angles. The dielectric cover 278 may be sized to fit over multiple stacked patch radiating elements 200 in an antenna array. In some embodiments, dielectric cover 278 may be sized to fit over all of stacked patch radiating elements 200 in the antenna array.

Figure 7D:
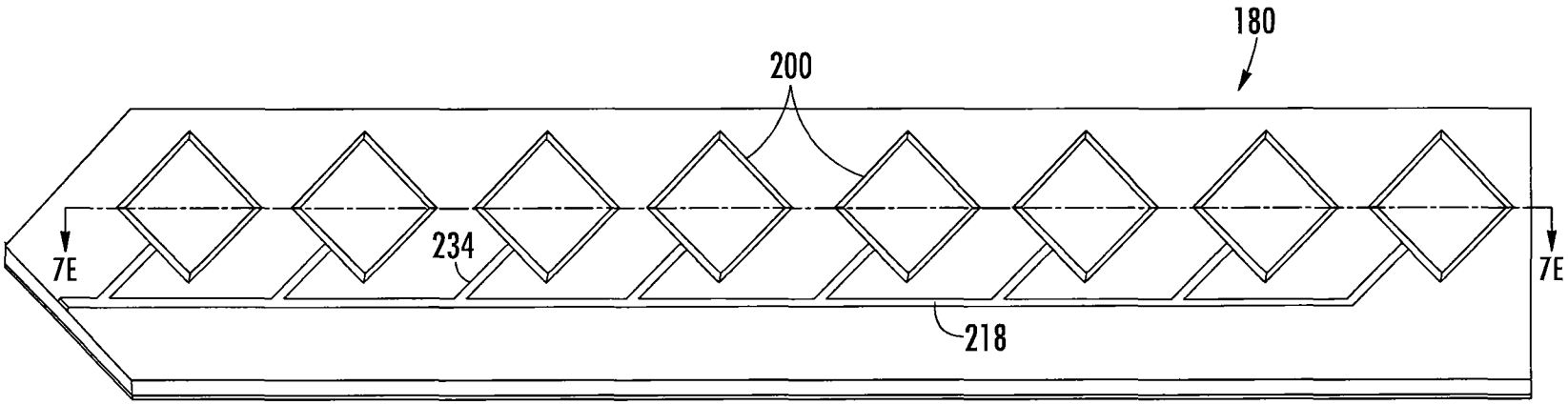
FIG. 7D is a plan view of a linear array that includes eight of the pick-and-place stacked patch radiating elements of FIG. 7A.

As can further be seen in FIGS. 7C and 7D, one or more vent holes 213 may be formed through the dielectric substrate 212. Each vent hole 213 may simply be an opening having a circular horizontal cross section that is formed through the dielectric substrate 212. While a single vent hole 213 is shown in FIGS. 7C and 7D, it will be appreciated that multiple vent holes 213 may be used in other embodiments. As known to those of skill in the art, solder paste comprises small balls of solder contained in a flux material. The flux material renders the solder flowable at room temperature. The flux is vaporized during heating and the vaporized flux may escape through the vent hole 213, which may reduce the possibility of voids forming in the molten solder that could adversely effect either or both the physical bond or the electrical connection between the patch radiator 230 and the conductive solder contact layer 244. The removal of the flux may also help assure consistent alignment of the parasitic radiating elements 250 on the patch radiating elements 220. The vent hole 213 may be a plated metal hole or a non-plated hole. If the vent hole 213 is plated, adjustments may be made to other parameters of the stacked patch radiating element 200 to accommodate the change in impedance caused by the additional metallization. The vent hole 213 included in the stacked patch radiating element 200 is a non-plated vent hole. The vent hole 213 may be located underneath the center of the patch radiator 230 as a null may exist in the current at this location. By not plating the vent hole 213, the likelihood of solder seeping out through the vent hole 213 may be reduced or eliminated.

Figure 7E:
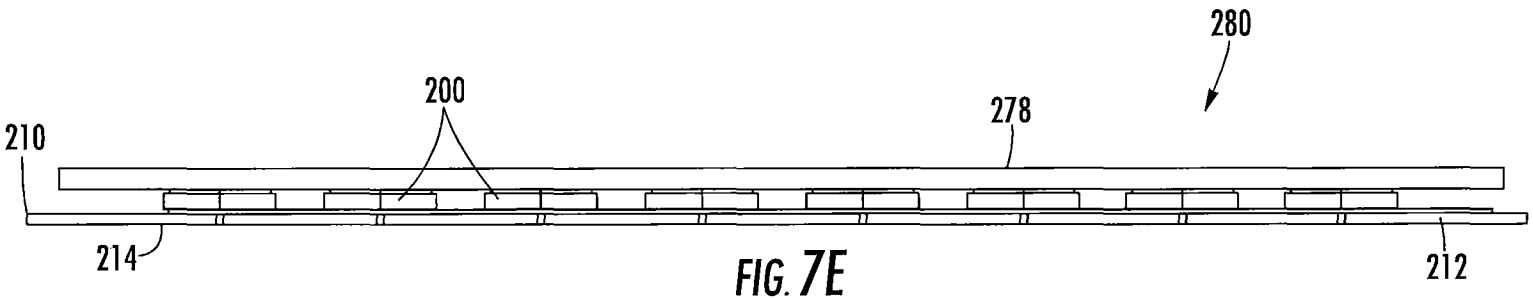
FIG. 7E is a cross-sectional view taken along line 7E-7E of FIG. 7D.

FIG. 7D is a schematic perspective view of a linear array 280 that includes eight of the pick-and-place stacked patch radiating elements 200 of FIG. 7A. FIG. 7E is a cross-sectional view taken along line 7E-7E of FIG. 7D.

As shown in FIGS. 7D-7E, the linear array 280 of pick-and-place stacked patch radiating elements 200 includes a total of eight patch radiating elements 200 that are formed in the mounting substrate 210. The dielectric substrate 212 of the mounting substrate 210 acts as the dielectric substrate 212 for each of the patch radiating elements 220, the conductive ground plane layer 214 on the lower surface of the dielectric substrate 212 acts as the ground plane for each of the patch radiating elements 220, and the metal pattern 216 on the upper surface of the dielectric substrate 212 includes eight patch radiators 230 and eight corresponding feed lines 234, along with a transmission line 218 that connects to each of the feed lines 234 to commonly feed the eight patch radiating elements 220.

Various parameters including the length L, width W and inset dimensions of the patch radiator 230, the length of the feed line 234 that extends from the transmission line 218 to the patch radiator 230, the length and width of the parasitic radiating element 260, the thickness and dielectric constant of the parasitic radiator dielectric substrate 242, and the thickness and dielectric constant of the dielectric cover 278 were optimized via computer simulation to provide an eight column antenna array of the stacked patch radiating elements 200 according to embodiments of the present invention that exhibits improved column active reflection coefficient performance for the above-described operating frequency band and scan angle range. The thicknesses of the dielectric substrates 212, 242 were constrained to thicknesses that are readily commercially available so that the increased costs of dielectric substrates with custom thicknesses would not be incurred.

Based on this performance optimization, an eight column antenna array of stacked patch radiating elements 200 having the following characteristics was designed using the periodic master/slave boundaries in the elevation plane in HFSS:

- Designed operating frequency: 27.5-28.35 GHz;
- Patch radiator 230 dimensions (L×W×D): 2.85 mm×2.85 mm×0.051 mm with a 0.30 mm feed inset;
- Dielectric substrate 212: 10 mil thick Rogers RO3003 substrate;
- Solder layer 274: 2 mil thickness
- Parasitic radiating element 250 dimensions (L×W×D): 3.3 mm×3.3 mm×0.381 mm;
- Solder contact metal layer 244 dimensions (L×W×D): 2.85 mm×2.85 mm×0.017 mm with a 0.30 mm feed inset;
- Parasitic radiator 260 dimensions (L×W×D): 2.85 mm×2.85 mm×0.017 mm with no inset;
- Parasitic radiator dielectric substrate 242 dimensions: 15 mil thick RT/Duroid 5880 dielectric substrate having a dielectric constant of about 2.2;
- Adhesive 276: 4 mil thick 3M 8153LE;
- Dielectric cover 278: 20 mil thick Rogers RO3003 dielectric substrate.

Ansys HFSS software was again used to simulate the active return loss performance of an eight column antenna array of the stacked patch radiating elements 200 of FIGS.

7A-7B. The return loss was simulated as a function of frequency across a 27.5-28.35 GHz operating frequency band for each of three different scan angles when the active antenna array was scanned in the azimuth plane to steer the antenna beam to different azimuth pointing directions. In these simulations, conditions were set as if the active antenna array included eight columns of the stacked patch radiating elements 200, where each column included an infinite number of radiating elements 200, and each column was fed by a separate transceiver. Periodic master/slave boundary conditions were set for broadside elevation scan. The vertical spacing between horizontal "rows" of the antenna array was assumed to be 6.70 mm, which corresponds to a full guided wavelength at the center frequency of the 27.5-28.35 GHz operating frequency band. Accordingly, adjacent stacked patch radiating elements 200 in a physical linear array 280 are fed with sub-components of an RF signal to be transmitted that are 360 degrees offset in phase, so that these sub-components will constructively combine. The horizontal spacing between the 8 vertical columns of the antenna array was assumed to be 5.50 mm to allow scanning to 60 degrees in azimuth plane.

Figure 8A:
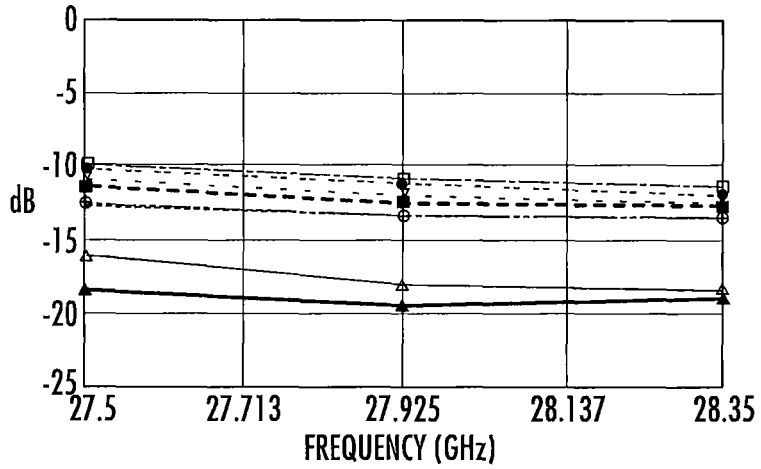
FIGS. 8A-8C are a series of graphs illustrating the simulated column active reflection coefficient as a function of frequency and azimuth antenna beam scanning angle for an eight column antenna array of the pick-and-place stacked patch radiating elements of FIG. 7A.
Figure 8B:
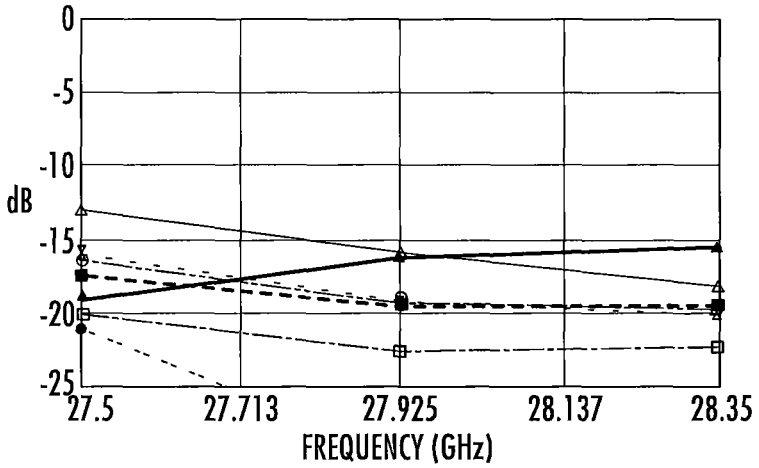
Figure 8C:
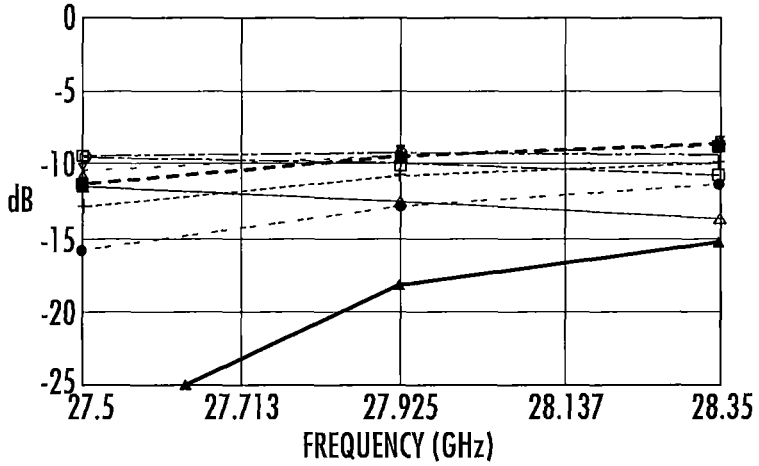

FIGS. 8A-8C are graphs illustrating the simulated column active reflection coefficient as a function of frequency and azimuth antenna beam scanning angle for the above-described eight column antenna array. In particular, FIG. 8A illustrates the simulated column active reflection coefficient when the antenna beam is pointed at the boresight pointing direction of the active antenna array, FIG. 8B illustrates the simulated column active reflection coefficient when the antenna beam is scanned 30 degrees in the azimuth plane, and FIG. 8C illustrates the simulated column active reflection coefficient when the antenna beam is scanned 60 degrees in the azimuth plane. In designing the antenna array, the performance at a 0 degree scan angle was traded off to improve performance at a 60 degree scan. The design goal again was an active reflection coefficient of less than −10 dB across the entire operating frequency band (27.5-28.3 GHz) at azimuth scan angles of up to 60 degrees. As with FIGS. 3A-3C and FIGS. 6A-6C, eight different curves are plotted in FIGS. 8A-8C to illustrate the active reflection coefficient performance for the eight different columns in the active antenna array.

As can be seen from FIG. 8A, when the beam is not scanned, the array of pick-and-place stacked patch radiating elements 200 according to embodiments of the present invention met the design goal of less than −10 dB active reflection coefficient across the entire operating frequency band. The active reflection coefficient is asymmetric with respect to frequency, with improved active reflection coefficient performance at the higher frequencies in the operating frequency band.

As shown in FIG. 8B, when the antenna beam is scanned 30 degrees in the azimuth plane, the design goal for active reflection coefficient performance is again met across the entire operating frequency band, with at least nearly 3 dB of margin at all frequencies.

As shown in FIG. 8C, when the antenna beam is scanned 60 degrees in the azimuth plane, the design goal for active reflection coefficient performance is met for all but one of the linear arrays 280, which barely fails to meet the goal at the high end of the operating frequency band. The results shown in FIGS. 8A-8C show that an array of pick-and-place stacked patch radiating elements according to embodiments of the present invention will generally meet the design goal for return loss performance.

Figure 9A:
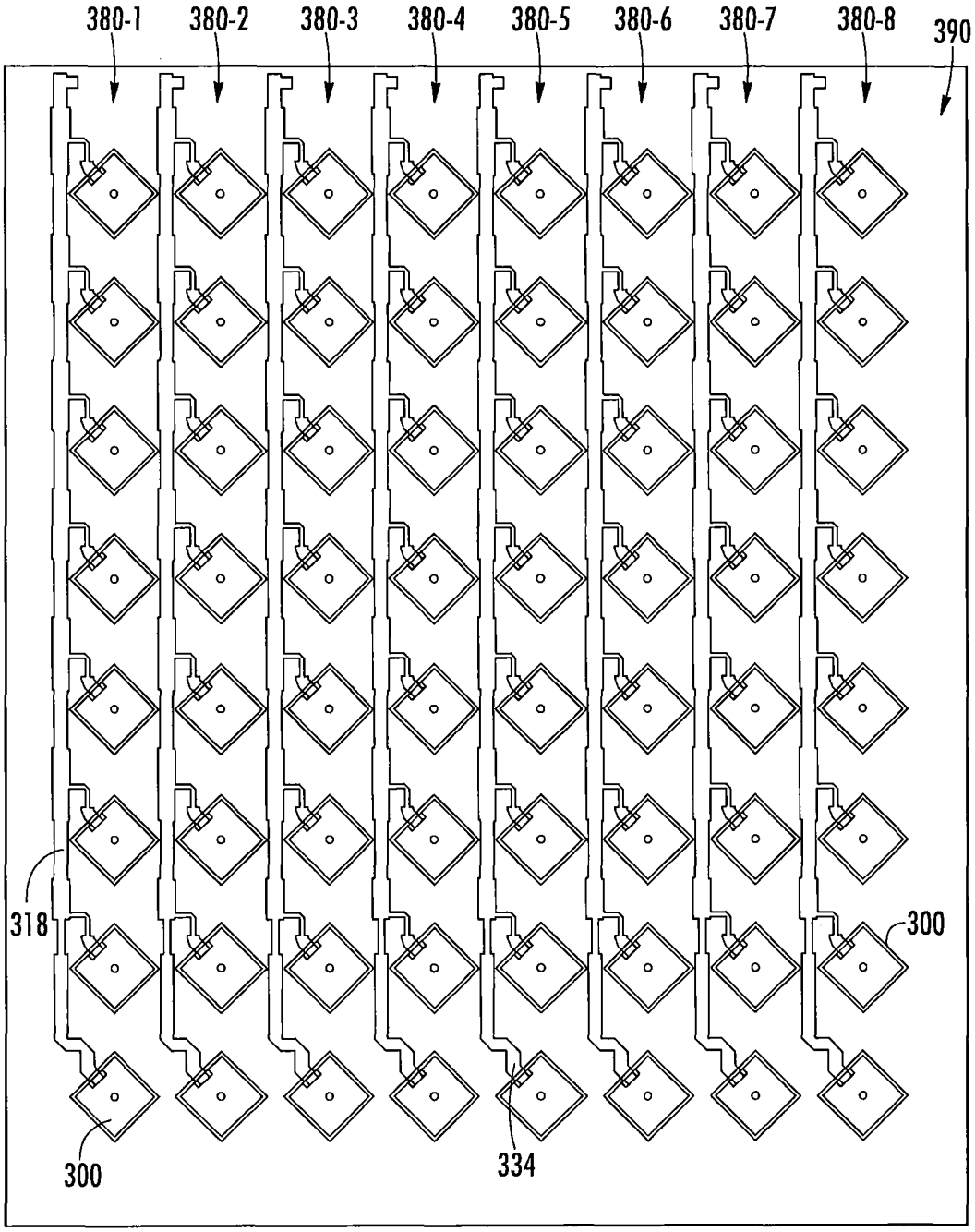
FIG. 9A is a plan view of an 8×8 array of pick-and-place stacked patch radiating elements according to embodiments of the present invention.
Figure 9B:
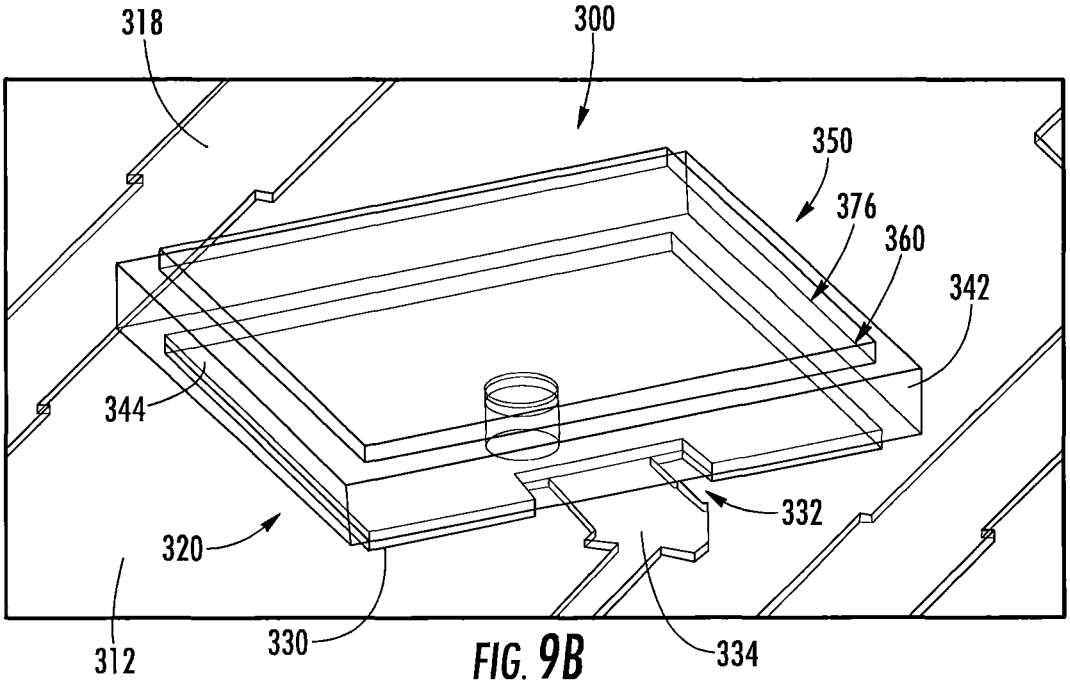
FIG. 9B is an enlarged plan view of one of the pick-and-place stacked patch radiating elements included in the 8×8 array of FIG. 9A.
Figure 9C:
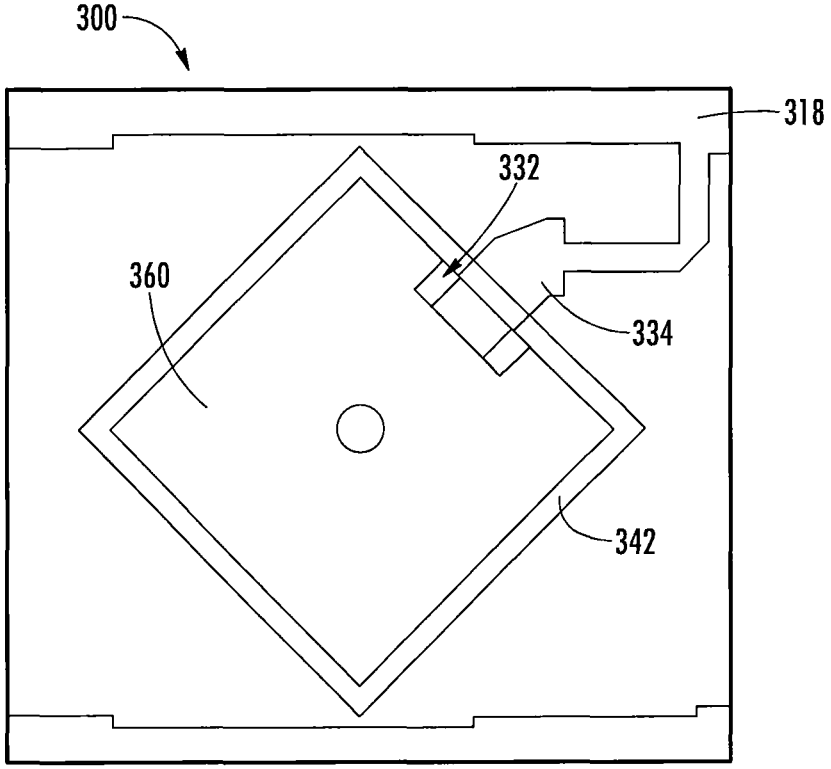
FIG. 9C is a perspective view of one of the pick-and-place stacked patch radiating elements included in the 8×8 array of FIG. 9A.

FIGS. 9A-9C illustrate an 8×8 active antenna array 390 that includes a plurality of pick-and-place stacked patch radiating elements according to embodiments of the present invention. In particular, FIG. 9A is a plan view of the active antenna array 390, and FIGS. 9B and 9C are enlarged perspective and plan views of one of the pick-and-place stacked patch radiating elements 300 included in the active antenna array 390.

The 8×8 active antenna array 390 may comprise eight transmission lines 318. Eight pick-and-place stacked patch radiating elements 300 according to embodiments of the present invention are connected to each of the transmission lines 318 via respective feed lines 334. The pick-and-place stacked patch radiating elements 300 connected to each transmission line are arranged in respective columns 380-1 through 380-8. The active antenna array 390 may have a switched elevation beamwidth capability having the design of any of the switched elevation beamwidth networks described in U.S. Provisional Patent Application Ser. No. 62/506,100, filed May 15, 2017, the entire content of which is incorporated herein by reference. While not shown in FIGS. 9A-9C, one or more switches such as PIN diodes are provided along each of the transmission lines 318 to allow the elevation beamwidth of an antenna beam generated by the active antenna array 390 to be switched between two or more different elevation beamwidths (some wider, others narrower) on, for example, a time slot by time slot basis. The azimuth pointing angle of the antenna beams generated by the active antenna array 390 may be scanned off of the azimuth boresight pointing direction of the active antenna array 390.

FIG. 9B is a perspective view of one of the stacked patch radiating elements 300 included in the active antenna array 390. As shown in FIG. 9B, the stacked patch radiating element 300 includes a patch radiator 330 that is formed on an upper surface of a dielectric substrate 312. A ground plane (not shown) may be formed on the lower surface of the dielectric substrate 312. An inset feed line 334 may connect to the patch radiator 330 within a recess 332. As can be seen in FIG. 9A, the other end of the feed line 334 connects to one of the transmission lines 318.

A parasitic radiating element 350 is mounted on the patch radiator 330 by forming molten solder on the patch radiator 330 and then using pick and place equipment to mount the parasitic radiating element 350 on the molten solder in the manner described above with reference to FIGS. 7A-7C. The parasitic radiating element includes a conductive solder contact layer 344, a parasitic radiator dielectric substrate 342 and a parasitic radiator 360. A dielectric cover (not shown) may be mounted above the parasitic radiating elements 350.

In the embodiment of FIGS. 9A-9C, each patch radiating element 300 may be arranged at a 45 degree angle so as to transmit RF signals at a +45 degree linear polarization. In this embodiment, the stacked patch radiating elements 300 had the following characteristics:

- Designed operating frequency: 27.5-28.35 GHz;
- Patch radiator 330 dimensions (L×W×D): 2.95 mm×2.95 mm×0.051 mm with a 0.35 mm feed inset;
- Dielectric substrate 312: 10 mil thick Rogers RO3003 substrate;
- Solder layer: 2 mil thickness
- Solder contact metal layer 344 dimensions (L×W×D): 2.95 mm×2.95 mm×0.017 mm with a 0.35 mm feed inset;
- Parasitic radiator 360 dimensions (L×W×D): 2.95 mm×2.95 mm×0.017 mm with no inset;

Parasitic radiator dielectric substrate 342 dimensions: 3.3 mm×3.3 mm×15 mil thick RT/Duroid 5880LZ dielectric substrate having a dielectric constant of about 2.0;

Adhesive 376: 4 mil thick 3M 8153LE;

Dielectric cover: 0.508 inch thick Rogers RO3003 dielectric substrate.

Figure 10A:
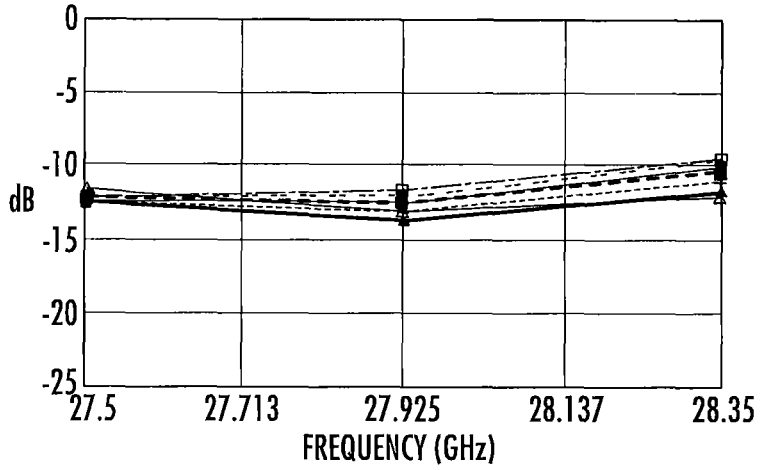
FIGS. 10A-10C are a series of graphs illustrating the column active reflection coefficient as a function of frequency and azimuth antenna beam scanning angle for the 8×8 array of pick-and-place stacked patch radiating elements of FIG. 9A.
Figure 10B:
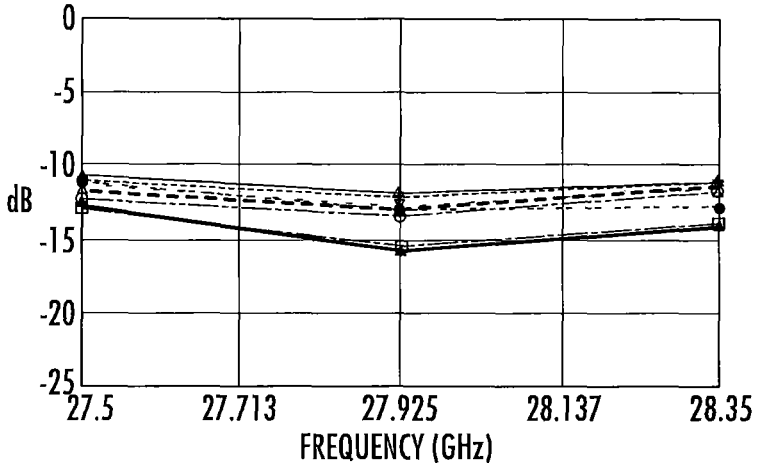
Figure 10C:
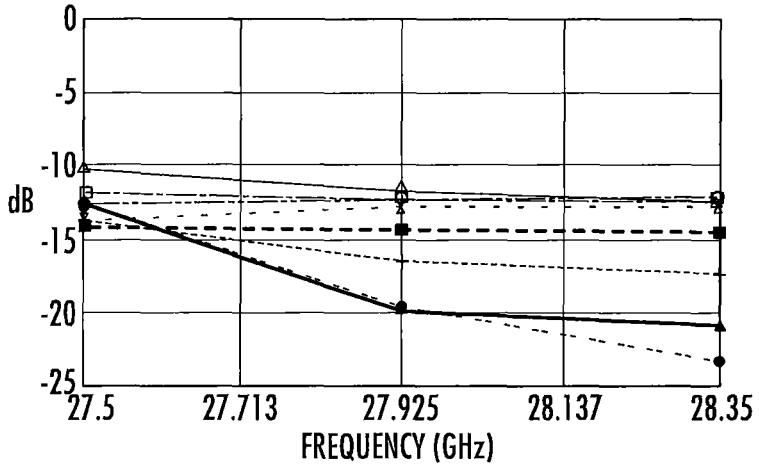

FIGS. 10A-10C are graphs illustrating the simulated column active reflection coefficient as a function of frequency and azimuth antenna beam scanning angle for the active antenna array 390. In particular, FIG. 10A illustrates the simulated column active reflection coefficient when the antenna beam is pointed at the boresight pointing direction of the antenna array, FIG. 10B illustrates the simulated column active reflection coefficient when the antenna beam is scanned 30 degrees in the azimuth plane, and FIG. 10C illustrates the simulated column active reflection coefficient when the antenna beam is scanned 60 degrees in the azimuth plane.

As can be seen from FIG. 10A, when the beam is not scanned, the active antenna array 390 is designed to meet the design goal of less than −10 dB active reflection coefficient across the entire operating frequency band. As shown in FIG. 10B, when the antenna beam is scanned 30 degrees in the azimuth plane, the design goal for active reflection coefficient performance is again met across the entire operating frequency band. As shown in FIG. 10C, when the antenna beam is scanned 60 degrees in the azimuth plane, the design goal for active reflection coefficient performance is again met across the entire operating frequency band for all eight linear arrays. Thus, the active antenna array 390 meets the active reflection coefficient design goal across the entire operating frequency band at all scan angles.

Figure 11:
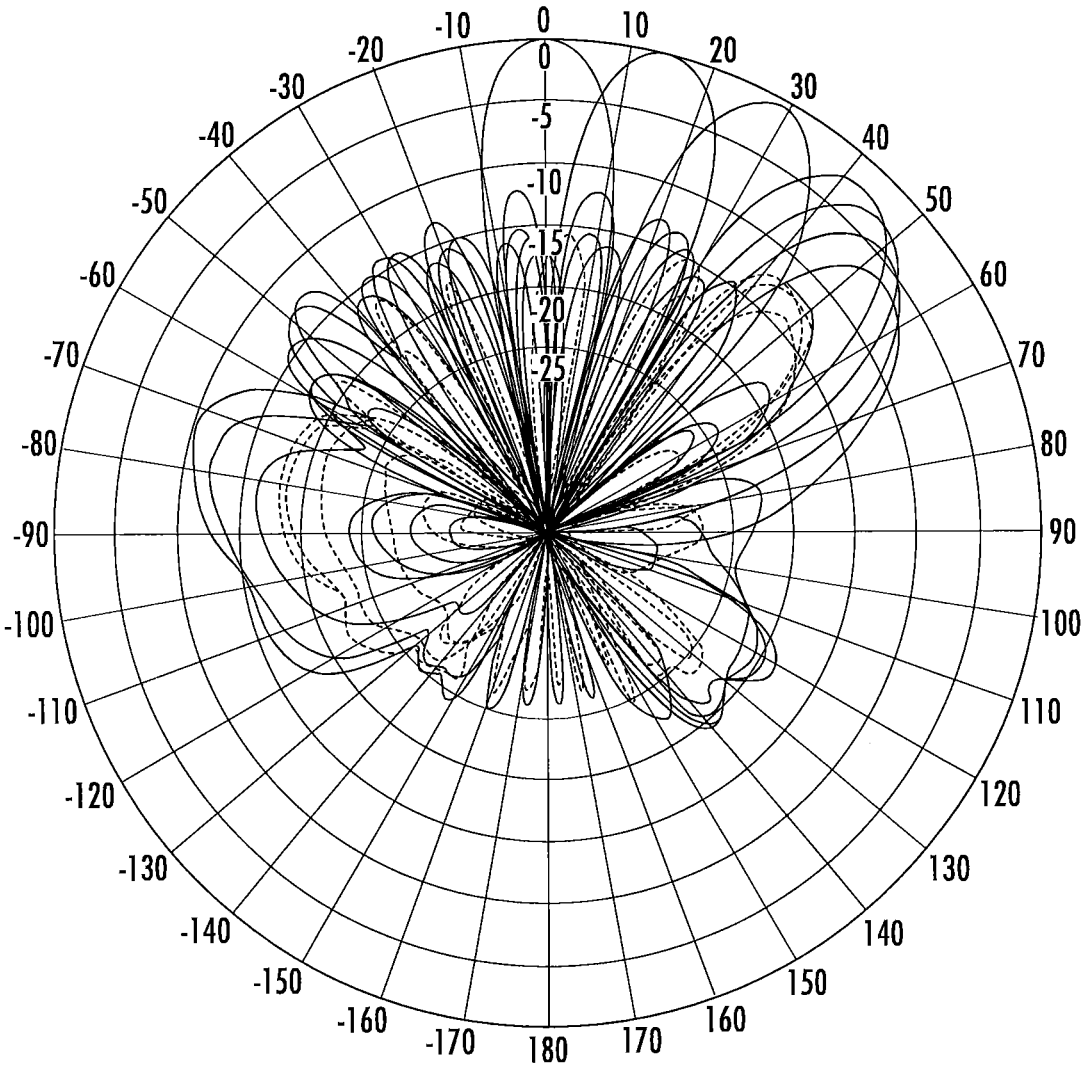
FIG. 11 is a graph of the simulated azimuth patterns for the active antenna array of FIGS. 9A-9D scanned various amounts on the azimuth plane.

FIG. 11 is a graph illustrating the typical simulated azimuth patterns normalized to the gain at boresight for the active antenna array 390 scanned (in the azimuth plane) to 0, 15, 30, 45, 50, 55 and 60 degrees. As can be seen, at a 60 degree scan the gain is about 6 dB down from the gain at boresight.

Referring again to FIGS. 8A-8C and to FIGS. 10A-10C, it can be seen that the active reflection coefficient performance may vary significantly based on the position of each linear array within the active antenna array. This variation may be reduced by allowing the dimensions of the patch radiators (or other elements of the stacked patch radiating elements according to embodiments of the present invention) to vary based on the position of the stacked patch radiating element within the active antenna array. Such a technique may further optimize performance, but may add additional design and/or manufacturing costs. In some embodiments, additional rows and/or columns of "dummy" stacked patch radiating elements could be provided on one or more sides of the active antenna array to create more uniform coupling, reducing the variation in performance based on column position. The rows and/or columns of dummy stacked patch radiating elements may be identical to the remaining rows/columns of stacked patch radiating elements in the active antenna array except that the rows/columns of dummy stacked patch radiating elements are not connected to a radio but rather are terminated into a matched load.

Figure 12:
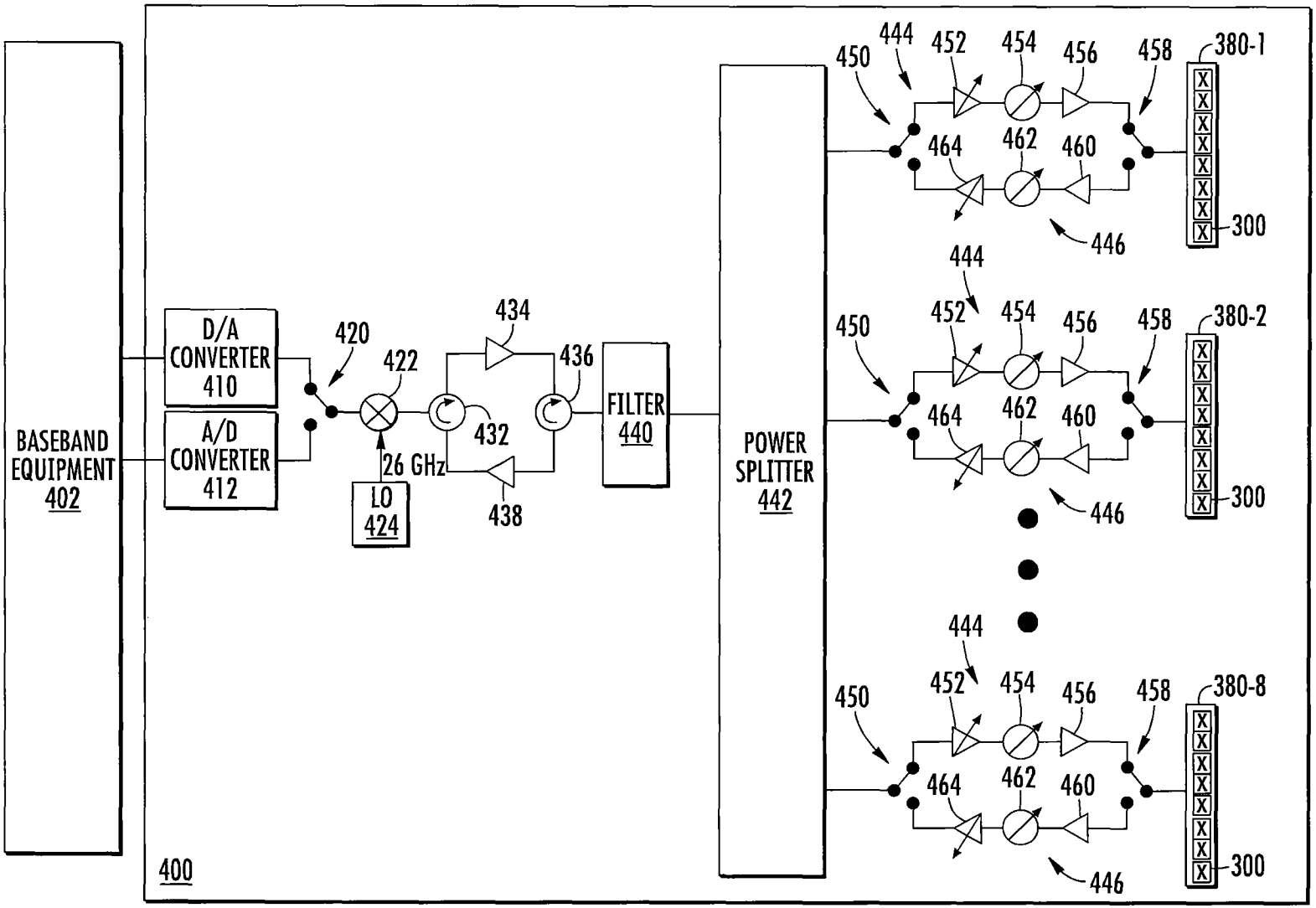
FIG. 12 is a schematic block diagram of a millimeter wave active antenna array that includes the active antenna array of FIGS. 9A-9D.

FIG. 12 is a schematic block diagram of a millimeter wave active phased array antenna (also referred to as an active antenna array") 400 that includes the 8×8 array 390 of FIGS. 9A-9C. As shown in FIG. 12, the active antenna array 400 includes a plurality of stacked patch radiating elements 300 which may be arranged, for example, in a two dimensional array that has eight vertical linear arrays 380 that are arranged side-by-side to form the 8×8 array 390.

As further shown in FIG. 12, the active antenna array 400 may be connected to baseband equipment 402. The active antenna array 400 may or may not be co-located with the baseband equipment 402. The baseband equipment 402 may perform functions such as digital coding, equalization and synchronization to data that is to be transmitted by the active antenna array 400 or that is received by the active antenna array 400. The baseband equipment 402 may include an interface to a backhaul network.

Baseband data (e.g., digital data in a 100 MHz frequency band centered at 0 Hz) may be received from the baseband equipment 402 and fed to a digital-to-analog ("D/A") converter 410. The digital-to-analog converter 410 may convert this digital data to an intermediate frequency analog signal. In an example embodiment, the intermediate frequency signal may be a 2 GHz signal, but it will be appreciated that any suitable intermediate frequency may be used, or that the output of the digital-to-analog converter 410 may be at baseband. The analog signal output by digital-to-analog converter 410 is fed to a first transmit/receive switch 420. The first transmit/receive switch 420 is provided because in 5G cellular communications systems typically are time division multiplexed systems where different users or sets of users may be served during different time slots, and in many cases the same frequencies (but different time slots) may be used for transmitting and receiving signals. For example, each 10 millisecond period (or some other small period of time) may represent a "frame" that is further divided into dozens or hundreds of individual time slots. Each user may be assigned one of the time slots and the base station may be configured to communicate with the different users during their individual time slots of each frame. With full two dimensional beam-steering, the base station antenna may generate small, highly-focused antenna beams on a time slot-by-time slot basis. These highly-focused antenna beams, and the phases and amplitudes of the sub-components fed to each radiating element (or to groups of radiating elements) are adjusted in order to steer the narrow antenna beam so that it points at different users during each respective time slot.

Referring again to FIG. 12, the transmit/receive switch 420 may be set either to feed data to be transmitted down a transmit signal path that extends between the digital-to-analog converter 410 and the stacked patch radiating elements 300 or to feed signals received at the stacked patch radiating elements 380 down a receive signal path that extends between the stacked patch radiating elements 300 and an analog-to-digital converter 412. Transmit signals passed through the transmit/receive switch 420 are passed to an up/down converter 422. The up/down converter 422 may be fed by a local oscillator 424 that generates, for example, a 26 GHz signal. In an alternate embodiment, the local oscillator 424 produces a 13 GHz signal that is doubled in frequency by the up/down converter before multiplying with the 2 GHz data signal. The up/down converter 422 may multiply the 2 GHz data signal output through the transmit/receive switch 420 by the 26 GHz local oscillator signal to up-convert the 2 GHz data signal to 28 GHz. This 28 GHz signal may be output by the up/down converter 422 to a first circulator 432 (or, alternatively, another transmit/receive switch). The first circulator routes the 28 GHz signal to an amplifier 434 that increases the signal level to maintain an acceptable signal-to-noise ratio. The output of the amplifier 434 is fed to a second circulator 436 (or, alternatively, another transmit/receive switch) which feeds the signal to a filter 440.

The filter 440 may comprise a bandpass filter that filters out intermodulation products generated at the up/down converter 422 and any other unwanted signals or noise. For example, the filter 440 may comprise a 28 GHz bandpass filter. The filtered 28 GHz signal output by filter 440 is passed to a 1×8 power coupler 442 that splits the RF signal that is to be transmitted into eight sub-components (which may or may not have equal amplitudes depending upon the design of the power coupler 442). Each of the eight sub-components then passes along a one of eight transmit paths 444 to a respective one of the columns 380 of radiating elements 300.

Focusing on the first of the eight transmit paths 444 (i.e., the one feeding linear array 380-1), the sub-component of the RF signal output by the power coupler 442 is passed to a second transmit/receive switch 450. The second transmit/receive switch 450 passes the sub-component of the RF signal to a variable attenuator 452 that may be used to reduce the magnitude thereof. The variable attenuator 452 may comprise, for example, a variable resistor that has a plurality of different resistance values that can be selected by application of a control signal. Each variable attenuator 452 may thus be used to reduce the magnitude of a signal supplied thereto by an amount determined by a control signal provided to the variable attenuator 452. The sub-component of the RF signal output by the variable attenuator 452 is passed to a variable phase shifter 454 that may be used to modify the phase of the sub-component of the RF signal. The variable phase shifter 454 may comprise, for example, an integrated circuit chip that may adjust the phase of a millimeter wave signal input thereto. A control signal supplied to the variable phase shifter 452 may select one of a plurality of phase shifts. The output of the variable phase shifter 454 is passed to a high power amplifier 456 that amplifies the sub-component of the RF signal to an appropriate transmit level. The amplified sub-component of the RF signal is then passed to the first linear array 380-1 of radiating elements 300 for over the air transmission. A splitter/combiner network (not shown) may further split the sub-component of the RF signal to pass a portion of the sub-component of the RF signal to each of the radiating elements 300 in the linear array 380.

When operating in receive mode, a millimeter wave signal (e.g., a 28 GHz signal) may be received at each of the eight radiating elements 300 of the first linear array 380-1. The above-mentioned splitter/combiner network (not shown) may combine the eight sub-components of the received signal and pass the combined received signal through the transmit/receive switch 458 to a receive path 446. The receive path 446 includes a low noise amplifier 460. The low noise amplifier amplifies the received signal and passes it to an adjustable phase shifter 462. The output of the variable phase shifter 462 is passed to a variable attenuator 464 that may be used to reduce the magnitude of the received signal. The output of the variable phase shifter 462 is passed to the second transmit/receive switch 450. which passes the signal to the power coupler 442 which combines the RF signals received at each of the eight linear arrays 380 that are passed along the eight receive paths 446. The power combiner 442 passes the combined RF signal to the filter 440, which filters out unwanted signals and noise.

The received signal is fed from the filter 440 to the second circulator 436 which feeds the signal to a low noise amplifier 438. The low noise amplifier 438 increases the level of the received signal to maintain an acceptable signal-to-noise ratio. The received signal is then passed through the first circulator 432 to the up/down converter 422, which uses the local oscillator signal to downconvert the received signal to an intermediate frequency (e.g., 2.0 GHz). This downconverted signal is passed through the first transmit/receive switch 420 to an analog-to-digital converter 412. The output of the analog-to-digital converter 412 is fed to the baseband equipment 402.

While the above discussion only describes one of the transmit paths 444 and one of the receive paths 446, it will be appreciated that the other transmit and receive paths 444, 446 may operate in the same manner as the ones discussed above.

As shown in FIG. 12, in an example embodiment, the antenna array 390 may include a plurality of columns 380 of radiating elements 300, and each column 380 may be fed in a similar manner. In the depicted embodiment, the same transmit signal is fed to each radiating element 300 in a respective column 380.

The stacked patch radiating elements according to embodiments of the present invention and antenna arrays including such stacked patch radiating elements may have a number of advantages over prior art stacked patch radiating elements and associated antenna arrays. By using individual parasitic radiating element "pucks" that are soldered to the patch radiators it is possible to use any appropriate dielectric substrate for the parasitic radiating elements, as opposed to ones that are appropriately matched to the dielectric substrate of the patch radiating element. Thus, both the thickness and the dielectric constant of the parasitic radiator dielectric substrate can be selected to improve the performance of the stacked patch radiating element. Typically, increased thickness and reduced dielectric constant for the parasitic radiator dielectric substrate correspond to increased bandwidth. Thus, the thickness and the dielectric constant of the dielectric substrate of the patch radiating element may be selected to provide desirable feed network properties and good impedance match (and hence good return loss performance) while the thickness and dielectric constant of the parasitic radiator dielectric substrate may be selected to improve the radiation performance of the stacked patch radiating element.

The stacked patch radiating elements according to embodiments of the present invention may be fabricated using standard printed circuit processing techniques and standard routing techniques for singulating a plurality of parasitic radiating elements from a printed circuit board. The thickness and dielectric constant of the parasitic radiator dielectric substrate provide additional design variables that may be used to optimize the impedance match over the beam scanning range. Low dielectric constants may provide improved antenna patterns. In an example embodiment, the parasitic radiator dielectric substrate may be a 15 mil thick 5880LZ dielectric substrate available from Rogers that has a dielectric constant of about 2.0, but a wide variety of other dielectric substrates may be used.

Since the parasitic radiating elements are small individual elements ("pucks") that are mounted on each patch radiating element by a soldered connection, the coefficient of thermal expansion of the parasitic radiator dielectric substrate need not be matched to the coefficient of thermal expansion of the dielectric substrate that is part of each patch radiating element. As such, the thickness and dielectric constant of the parasitic radiator dielectric substrate are additional variables that may be selected to improve the scan impedance bandwidth of the antenna array.

Additionally, the "puck" parasitic radiating element design provides a convenient mechanism for attaching the parasitic radiating elements to the underlying patch radiating elements so that each parasitic radiating element will be aligned with their corresponding patch radiating elements in the length, width and rotational directions. Since the surface tension of the solder may automatically perform this alignment very high degrees of alignment may be achieved.

A further advantage of the stacked patch radiating elements according to embodiments of the present invention is that the individual parasitic radiating element "pucks" allow additional surface mount components to be soldered in between adjacent stacked patch radiating elements. For example, the PIN diodes included in the microstrip feed within the elevation feed networks described in the aforementioned U.S. Provisional Patent Application Ser. No. 62/522,859 may be mounted in between adjacent stacked patch radiating elements to allow for the switched elevation beamwidth antenna array.

It will be appreciated that numerous modifications may be made to the above-described embodiments without departing from the scope of the present invention. For example, while the pictured embodiments include edge-fed patch radiators, it will be appreciated that probe-fed patch radiating elements may be used in other embodiments. It will likewise be appreciated that patch radiators having other than square profiles may be used. As another example, instead of using a single large dielectric cover in other embodiments individual dielectric covers may be included in each puck. While only a single vent hole per stacked patch radiating element is depicted, in other embodiments multiple vent holes may be provided.

The present invention has been described above with reference to the accompanying drawings. The invention is not limited to the illustrated embodiments; rather, these embodiments are intended to fully and completely disclose the invention to those skilled in this art. In the drawings, like numbers refer to like elements throughout. Thicknesses and dimensions of some elements may not be to scale.

Spatially relative terms, such as "under", "below", "lower", "over", "upper", "top", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity. As used herein the expression "and/or" includes any and all combinations of one or more of the associated listed items.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention.

That which is claimed is:

1. A stacked patch radiating element, comprising:
- a dielectric substrate having first and second opposed surfaces;
- a ground plane on the first surface of the dielectric substrate;
- a patch radiator on the second surface of the dielectric substrate;
- a feed that is configured to connect the patch radiator to a transmission line;
- a solder layer on the patch radiator opposite the dielectric substrate; and
- a parasitic radiating element on the solder layer opposite the patch radiator, the parasitic radiating element including:
  - a metal layer on the solder;
  - a parasitic radiator dielectric substrate on the first metal layer opposite the solder; and
  - a parasitic radiator on the parasitic radiator dielectric substrate opposite the first metal layer.

2. The stacked patch radiating element of claim 1, wherein a footprint of the parasitic radiator is smaller than a footprint of the patch radiator.

3. The stacked patch radiating element of claim 1, wherein a center of the parasitic radiator is substantially aligned with a center of the patch radiator.

4. The stacked patch radiating element of claim 1, wherein the solder layer directly contacts both the patch radiator and the metal layer.

5. The stacked patch radiating element of claim 1, wherein the patch radiator is an inset patch radiator that includes an inset on one side, and wherein the transmission line connects to an interior portion of the patch radiator exposed through the inset.

6. The stacked patch radiating element of claim 5, wherein the metal layer includes an inset on one side, wherein the inset in the metal layer is substantially aligned with the inset in the patch radiator.

7. The stacked patch radiating element of claim 6, wherein the parasitic radiator does not include an inset in any side thereof.

8. The stacked patch radiating element of claim 1, wherein a footprint of the metal layer has substantially the same shape as a footprint of the patch radiator.

9. The stacked patch radiating element of claim 8, wherein a footprint of the parasitic radiator is different than a footprint of the metal layer.

10. The stacked patch radiating element of claim 1, wherein a first opening extends through the dielectric substrate and a second opening extends through the ground plane layer and connects to the first opening, the first and second openings being underneath the patch radiator.

11. The stacked patch radiating element of claim 1, further comprising a dielectric cover on the parasitic radiator opposite the parasitic radiator dielectric substrate.

12. The stacked patch radiating element of claim 11, wherein the dielectric cover is attached to the parasitic radiator via an adhesive layer.

13. The stacked patch radiating element of claim 1, wherein a first coefficient of thermal expansion of the parasitic radiator dielectric substrate differs from a second coefficient of thermal expansion of the dielectric substrate by at least 100%.

14. An active antenna array, comprising:
- a base board that includes:
  - a dielectric substrate having first and second opposed surfaces;

a ground plane on the first surface of the dielectric substrate;

a plurality of patch radiators on the second surface of the dielectric substrate; and a plurality of feeds, each feed configured to connect a respective one of the patch radiators to one of a plurality of transmission lines of a feed network;

a solder mask having a plurality of openings on the second surface of the dielectric substrate;

solder within the openings in the solder mask; and a plurality of parasitic radiating elements on the solder, each parasitic radiating element including:

a parasitic radiator dielectric substrate having a first surface and a second surface opposite the first surface;

a conductive solder contact layer on the first surface of the parasitic radiator dielectric substrate; and a parasitic radiator on the second surface of the parasitic radiator dielectric substrate.

15. The active antenna array of claim 14, wherein for each parasitic radiating element, a footprint of the parasitic radiator is different than a footprint of the conductive solder contact layer.

16. The active antenna array of claim 14, wherein for each parasitic radiator, a footprint of the conductive solder contact layer has substantially the same shape as a footprint of the patch radiator on which the parasitic radiating element is mounted.

17. The active antenna array of claim 14, wherein a first coefficient of thermal expansion of each parasitic radiator dielectric substrate differs from a second coefficient of thermal expansion of the dielectric substrate by at least 100%.

18. The active antenna array of claim 14, further comprising a plurality of dummy stacked patch radiating elements, each dummy stacked patch radiating element being substantially identical to an adjacent stacked patch radiating element except that a patch radiator of each dummy stacked patch radiating element is not connected to the feed network.

19. The stacked patch radiating element of claim 1, wherein the dielectric substrate includes at least one vent hole underneath the patch radiator, and the ground plane includes an opening that is in fluid communication with the vent hole.

20. The stacked patch radiating element of claim 19, wherein the vent hole is not plated with metal.

* * * * *